US008205883B2

(12) United States Patent
Fujita et al.

(10) Patent No.: US 8,205,883 B2
(45) Date of Patent: Jun. 26, 2012

(54) PAPER TRANSPORT PATH OF IMAGE FORMING APPARATUS

(75) Inventors: Masahiko Fujita, Nara (JP); Tadasu Taniguchi, Nara (JP); Masaharu Kimura, Osaka (JP); Yasuaki Fukada, Nara (JP); Masaya Asakawa, Nara (JP); Yasuhiro Takai, Nara (JP); Norichika Katsura, Nara (JP); Masatsugu Ohishi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 12/019,658

(22) Filed: Jan. 25, 2008

(65) Prior Publication Data

US 2008/0191413 A1 Aug. 14, 2008

(30) Foreign Application Priority Data

Feb. 14, 2007 (JP) ..... 2007-033847

(51) Int. Cl.
*B65H 39/10* (2006.01)

(52) U.S. Cl. ..... 271/303; 271/302

(58) Field of Classification Search ..... 271/65, 271/186, 301–305, 264, 19, 242
See application file for complete search history.

(56) References Cited

U.S. PATENT DOCUMENTS

| | | | | |
|---|---|---|---|---|
| 4,262,895 | A * | 4/1981 | Wenthe, Jr. | 271/65 |
| 4,553,831 | A * | 11/1985 | Dixon | 355/26 |
| 4,639,125 | A * | 1/1987 | Okuda et al. | 355/23 |
| 5,082,272 | A * | 1/1992 | Xydias et al. | 271/186 |
| 5,449,163 | A * | 9/1995 | Wong et al. | 271/186 |
| 5,690,325 | A * | 11/1997 | Morimoto | 271/65 |
| 5,868,387 | A * | 2/1999 | Kida et al. | 271/304 |
| 5,953,575 | A * | 9/1999 | Park et al. | 399/401 |
| 6,107,579 | A * | 8/2000 | Kinnemann | 177/145 |
| 6,161,828 | A * | 12/2000 | Sussmeier | 270/59 |
| 6,332,606 | B1 * | 12/2001 | Seki | 270/59 |
| 6,682,237 | B2 * | 1/2004 | Cocklin et al. | 400/624 |
| 7,722,180 | B2 * | 5/2010 | Mashima | 347/104 |
| 2002/0096822 | A1 * | 7/2002 | Glemser et al. | 271/186 |
| 2002/0158404 | A1 * | 10/2002 | Carter et al. | 271/186 |
| 2003/0071409 | A1 * | 4/2003 | Sumi et al. | 271/186 |
| 2003/0151191 | A1 * | 8/2003 | Watase | 271/242 |
| 2004/0217542 | A1 * | 11/2004 | Aguirre Camacho | 271/186 |
| 2007/0008394 | A1 * | 1/2007 | Mashima | 347/104 |

FOREIGN PATENT DOCUMENTS

| | | |
|---|---|---|
| JP | 50-102069 | 8/1975 |
| JP | 61-2653 | 1/1986 |
| JP | 11-165933 | 6/1999 |
| JP | 2002-326741 | 11/2002 |
| JP | 2002-293483 | 10/2003 |
| JP | 2005-060107 | 3/2005 |
| JP | 2005-247467 | 9/2005 |

* cited by examiner

*Primary Examiner* — Kaitlin Joerger
*Assistant Examiner* — Prasad Gokhale
(74) *Attorney, Agent, or Firm* — Renner, Otto, Boiselle & Sklar, LLP

(57) ABSTRACT

A transport path switching unit is provided between transport rollers and pre-registration rollers, and control is performed to switch between a main transport path and an extended transport path of the transport path switching unit such that either the main transport path or the extended transport path is interposed as the part of the paper transport path between the transport rollers and the pre-registration rollers to vary a total length of the paper transport path.

10 Claims, 12 Drawing Sheets

FIG.7

(a)

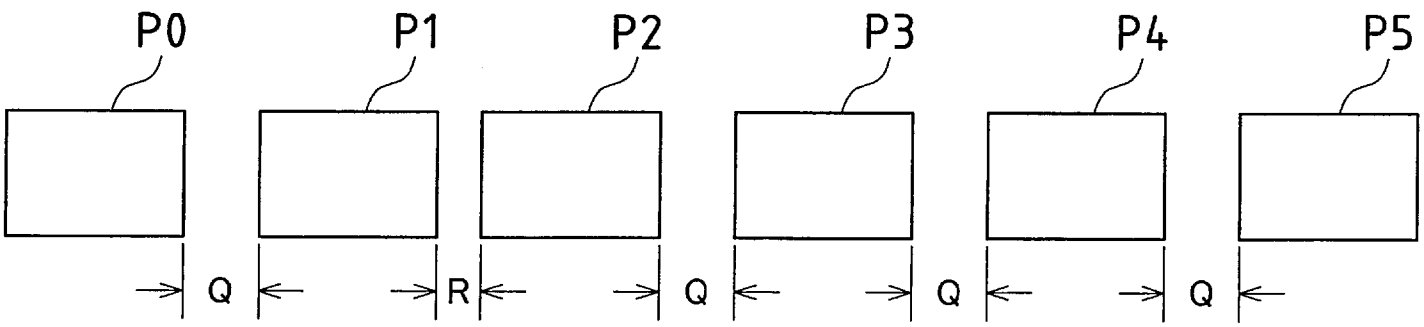

(b)

| paper | distance of spacing at paper leading edge side | control technique (transport speed) | transport path selection |
|---|---|---|---|
| P1 | appropriate(Q) | according to setting | main transport path |
| P2 | narrow(R) | acceleration transport above setting value | extended transport path |
| P3 | appropriate(Q) | according to setting | extended transport path |
| P4 | appropriate(Q) | according to setting | extended transport path |
| P5 | appropriate(Q) | according to setting | main transport path |

FIG.8

(a)

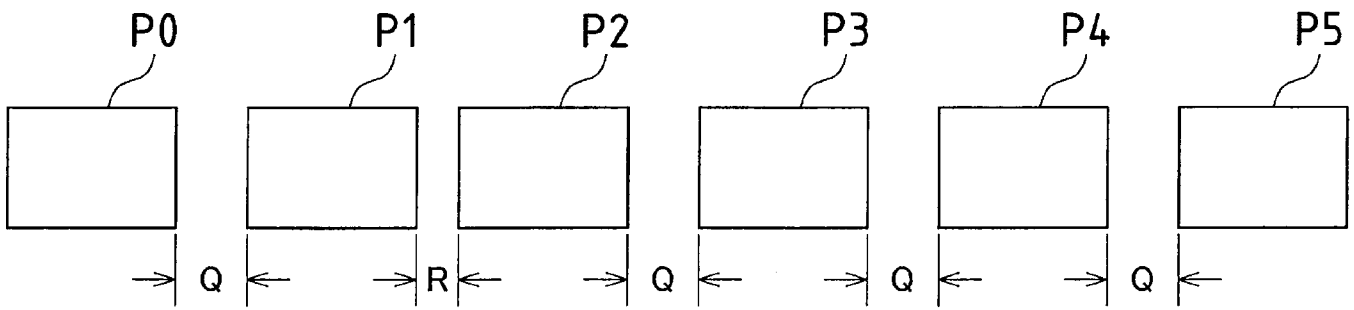

(b)

| paper | distance of spacing at paper leading edge side | control technique (transport speed) | transport path selection |
|---|---|---|---|
| P1 | appropriate(Q) | according to setting | main transport path |
| P2 | narrow(R) | deceleration transport below setting value | main transport path |
| P3 | appropriate(Q) | deceleration transport | main transport path |
| P4 | appropriate(Q) | deceleration transport | main transport path |
| P5 | appropriate(Q) | according to setting | main transport path |

FIG.9

(a)

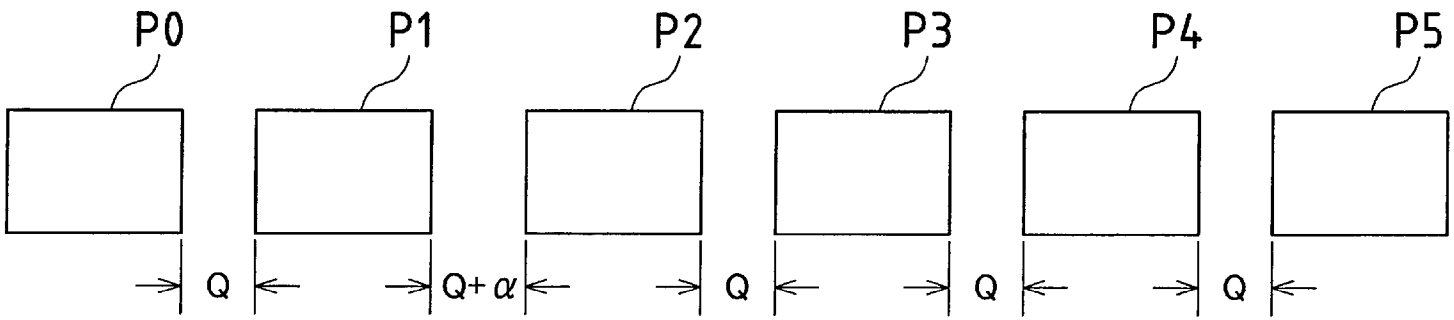

(b)

| paper | distance of spacing at paper leading edge side | control technique (transport speed) | transport path selection |
|---|---|---|---|
| P1 | appropriate(Q) | according to setting | main transport path |
| P2 | wide(Q+α) | acceleration transport above setting value | main transport path |
| P3 | appropriate(Q) | acceleration transport | main transport path |
| P4 | appropriate(Q) | acceleration transport | main transport path |
| P5 | appropriate(Q) | according to setting | main transport path |

PAPER TRANSPORT PATH OF IMAGE FORMING APPARATUS

BACKGROUND OF THE INVENTION

This application claims priority under 35 U.S.C. §119(a) on Patent Application No. 2007-033847 filed in Japan on Feb. 14, 2007, the entire contents of which are herein incorporated by reference.

The present invention relates to image forming apparatuses such as copiers, printers, and facsimile machines, and particularly relates to paper transport paths of image forming apparatuses in which a recording paper is temporarily stopped by registration rollers then transported to a print processing portion.

With this type of image forming apparatus, development has been advancing in recent years toward apparatuses having increased print processing speeds, for example apparatuses have been developed that perform print processing on 100 or more sheets/min. In this regard, along with increased print processing speeds such as these, much greater loads are being placed on paper transport mechanisms.

For example, when carrying out print processing at 100 sheets/min, it is necessary to set the print processing speed to approximately 450 to 600 mm/sec. On the other hand, to ensure an adjustment time in which the recording paper is temporarily stopped by the registration rollers immediately before the step of print processing, it is necessary to set the transport speed of the recording paper on the upstream side from the registration rollers at 600 to 1,500 mm/sec, which is even faster than the print processing speed, so as to make faster the timing by which the recording paper reaches the registration rollers, thereby gaining time for the adjustment there. This adjustment time is set so that the leading edge of the recording paper is aligned parallel to the registration rollers and also so that a timing by which the leading edge of the recording paper reaches the print processing step and a timing by which print processing commences are caused to coincide. In other words, along with increased print processing speeds, there is a necessity to set the transport speed of the recording paper on the upstream side from the registration rollers even faster, and this is a cause of placing much greater loads on paper transport mechanisms.

Furthermore, since it is difficult to achieve high-speed print processing with only higher transport speeds of the recording paper, the distance of the spacing between a preceding recording paper and a succeeding recording paper is being made smaller (see JP 2005-247267A).

However, the distances of spacing between recording papers is not always held constant and may vary. For example, recording paper is picked up and fed by a pickup roller in a paper feed portion, but due to variation in the extent of slipperiness of the surface of the recording paper, the pickup roller may slip such that the timing by which the recording paper is picked up may be delayed, thereby increasing the distances of spacing between the recording papers. Furthermore, when a preceding recording paper is picked up by the pickup roller, if the succeeding recording paper thereunder is dragged up by the preceding recording paper, then the succeeding recording paper will not return to its original position even if the succeeding recording paper is pulled apart from the preceding recording paper by separator rollers, and therefore the succeeding recording paper is picked up in a state in which it is close to the preceding recording paper, thereby reducing the distance of spacing between the recording papers.

For this reason, in a case where the distance of spacing between recording papers is set smaller in order to increase the speed of print processing as in JP 2005-247267A, the distance of spacing between recording papers is made even smaller when the succeeding recording paper is pulled up by the preceding recording paper, and there are large shifts in the timings by which the succeeding recording papers reach the registration rollers, such that transport control of the recording paper by the registration rollers is made difficult.

For example, in a case where the distance of spacing is set to 50 mm, when the succeeding recording paper is dragged up by the preceding recording paper by 30 mm, then the succeeding recording paper after that is picked up 30 mm earlier, and therefore the distance of spacing between the recording papers becomes 20 mm such that the timing by which the succeeding recording paper reaches the registration rollers is greatly shifted.

Accordingly, the present invention has been devised in consideration of the conventional problems, and it is an object thereof to provide a paper transport path of an image forming apparatus capable of adjusting the distance of spacing between recording papers when successively transporting a plurality of recording papers.

SUMMARY OF THE INVENTION

In order to address these issues, a paper transport path of an image forming apparatus according to the present invention is provided in which a recording paper is transported from a paper feed portion through a paper transport path to registration rollers and the recording paper is further transported to a print processing portion via the registration rollers such that printing is carried out on the recording paper by the print processing portion, and at least a part of the paper transport path on an upstream side from the registration rollers in a transport direction of the recording paper is controlled to switch between either a main transport path or an extended transport path, which is longer than the main transport path, such that the recording paper is guided to the registration rollers through either of the main transport path or the extended transport path.

With the present invention, either the main transport path or the extended transport path, which is longer than the main transport path, is switched and arranged on an upstream side from the registration rollers in a transport direction of the recording paper, such that the recording paper is guided to the registration rollers through either of the main transport path or the extended transport path. When the extended transport path is set, the extended transport path is longer than the main transport path and therefore the transport distance of the recording paper until reaching the registration rollers is lengthened. For this reason, when a preceding recording paper is transported through the main transport path and, following this, a succeeding recording paper is transported through the extended transport path, the succeeding recording paper is transported with a greater delay than the preceding recording paper and the distance of spacing between the trailing edge of the preceding recording paper and the leading edge of the succeeding recording paper becomes longer.

Accordingly, when the distance of spacing between the recording papers being transported successively becomes narrower than the prescribed spacing, the distance of spacing between the recording papers can be changed to be longer by transporting the succeeding recording paper through the extended transport path.

Furthermore, in the foregoing configuration, a reverse transport path, in which the recording paper is transported while a front and back of the recording paper are reversed, may be connected to the paper transport path, and the main transport path and the extended transport path may be provided between a connection location of the reverse transport path to the paper transport path and the registration rollers.

In a case where the reverse transport path in which recording paper is transported is connected to the paper transport path, sometimes a succeeding recording paper that has been transported through the reverse transport path becomes too close to the preceding recording paper and the distance of spacing between the recording papers becomes narrowed. However, by providing the main transport path and the extended transport path between a connection location of the reverse transport path to the main transport path and the registration rollers, the succeeding recording paper that has been transported through the reverse transport path can be transported through either the main transport path or the extended transport path.

Further still, in the foregoing configuration, a paper detection sensor that detects a leading edge and a trailing edge of the recording paper may be provided on an upstream side from the main transport path and the extended transport path in a transport direction of the recording paper, and control of switching between the main transport path and the extended transport path may be carried out based on a detection timing of a trailing edge of a preceding recording paper and a detection timing of a leading edge of a succeeding recording paper by the paper detection sensor in a state in which a plurality of sheets of recording paper is being transported successively.

In this case, the paper detection sensor is provided on an upstream side from the main transport path and the extended transport path, and the trailing edge of the preceding recording paper and the leading edge of the succeeding recording paper is detected by the paper detection sensor. The time interval between the detection timings of the trailing edge and the leading edge corresponds to the distance of spacing between the recording papers, and therefore by using these detection timings, control of switching between the main transport path and the extended transport path can be achieved in response to the distance of spacing between the recording papers.

Furthermore, in the foregoing configuration, the extended transport path may be used as at least a part of the paper transport path when a distance of spacing between a trailing edge and a leading edge of recording papers corresponding to a detection timing of a trailing edge of a preceding recording paper and a detection timing of a leading edge of a succeeding recording paper by the paper detection sensor is less than a prescribed spacing, and the main transport path may be used as at least a part of the paper transport path when a distance of spacing between a trailing edge and a leading edge of the recording papers is not less than the prescribed spacing.

For example, when the distance of spacing between the recording papers is less than the prescribed spacing, the distance of spacing between the recording papers can be changed to be longer by setting the extended transport path. Or when the distance of spacing between the recording papers is not less than the prescribed spacing, the distance of spacing between the recording papers is maintained by setting the main transport path.

Further still, in the foregoing configuration, when a recording paper is guided to the registration rollers through the extended transport path, transport acceleration control may be carried out in which a transport speed of the recording paper in the extended transport path is increased.

When the succeeding recording paper is transported through the extended transport path, the distance of spacing between preceding recording paper and the succeeding recording paper is increased, but the increased distance of spacing does not necessarily become the prescribed spacing. Consequently, in the foregoing configuration, transport acceleration control is carried out on the recording paper in the extended transport path to adjust the distance of spacing. In this case, the extended transport path is set sufficiently long so that the distance of spacing between the recording papers becomes longer than required, and the distance of spacing that is longer than required can be shortened to the prescribed spacing by performing transport acceleration control on the recording paper.

Furthermore, in the foregoing configuration, a paper detection sensor that detects a leading edge and a trailing edge of the recording paper may be provided on an upstream side from the main transport path and the extended transport path in a transport direction of the recording paper, wherein the extended transport path is used as at least a part of the paper transport path when a distance of spacing between a trailing edge and a leading edge of recording papers corresponding to a detection timing of a trailing edge of a preceding recording paper and a detection timing of a leading edge of a succeeding recording paper by the paper detection sensor is less than a prescribed spacing, and a transport speed for recording paper in the extended transport path may be set based on a difference in length between the main transport path and the extended transport path, the prescribed spacing between the trailing edge and leading edge of the recording papers, and the distance of spacing between the trailing edge and leading edge of the recording papers such that an adjustment time is ensured from a time point at which the leading edge of the succeeding recording paper reaches the registration rollers until a time point at which transport of the succeeding recording paper by the registration rollers commences.

In this case, a transport speed for recording paper in the extended transport path is set based on a difference in length between the main transport path and the extended transport path, the prescribed spacing between the trailing edge and leading edge of the recording papers, and the distance of spacing between the trailing edge and leading edge of the recording papers such that an adjustment time is ensured from a time point at which the leading edge of the succeeding recording paper reaches the registration rollers until a time point at which transport of the succeeding recording paper by the registration rollers commences. To ensure the adjustment time, the leading edge of the succeeding recording paper should be set to reach the registration rollers at a timing that is an adjustment time amount earlier than the time point at which transport of the succeeding recording paper by the registration rollers commences. For this reason, it is necessary to adjust the transport speed of the succeeding recording paper in the extended transport path, and the succeeding recording paper is transported delayed by a sum of its difference in distance from the preceding recording paper and the distance of spacing such that the spacing between the recording papers is widened by this sum, and therefore transport acceleration of the succeeding recording paper in the extended transport path should be controlled so that the spacing between the recording papers is narrowed from the sum of the distances of spacing to the prescribed spacing. As a result, the leading edge of the succeeding recording paper can be set to reach the registration rollers at a timing that is an adjustment time amount earlier than the time point at which transport of the succeeding recording paper by the registration rollers commences.

Further still, in the foregoing configuration, a difference in length between the main transport path and the extended transport path may be not less than a prescribed spacing between a preceding recording paper and a succeeding recording paper that is set when transporting a largest size recording paper printable by the image forming apparatus.

In this case, a difference in length between the main transport path and the extended transport path may be not less than a prescribed spacing between a preceding recording paper and a succeeding recording paper that is set when transporting a largest size recording paper printable by the image forming apparatus. Ordinarily, the prescribed spacing between recording papers varies depending on the size of the recording paper and is set wider for larger sizes of recording paper. When the distance of spacing between the recording papers is zero, the succeeding recording paper must be transported delayed by at least that prescribed spacing, and for this reason it is necessary to set the difference in length between the main transport path and the extended transport path to not less than the prescribed spacing, and since the prescribed spacing between recording papers is largest when the recording paper is the largest size, it is necessary that the difference in length therebetween is set to the largest prescribed spacing.

Furthermore, in the foregoing configuration, transport speeds in the paper transport path, the main transport path, and the extended transport path may be higher than a transport speed from the registration rollers to the print processing portion.

To ensure an adjustment time in which the recording paper is temporarily stopped by the registration rollers, it is necessary to set the transport speed of the recording paper on the upstream side from the registration rollers sufficiently faster than the print processing speed, so as to make faster the timing by which the recording paper reaches the registration rollers. For this reason, as in the foregoing configuration, transport speeds in the paper transport path, the main transport path, and the extended transport path are set higher than the transport speed from the registration rollers to the print processing portion.

Further still, in the foregoing configuration, an adjustment time from a time point at which a leading edge of the recording paper reaches the registration rollers until a time point at which transport of the recording paper by the registration rollers commences may be set so that a timing at which printing on the recording paper by the print processing portion commences and a timing at which the leading edge of the recording paper reaches the print processing portion are matched.

In this case, the adjustment time from a time point at which a leading edge of the recording paper reaches the registration rollers until a time point at which transport of the recording paper by the registration rollers commences is set so that a timing at which printing on the recording paper by the print processing portion commences and a timing at which the leading edge of the recording paper reaches the print processing portion are matched. In this way, occurrences of printing discrepancies on the recording paper are eliminated.

Furthermore, in the foregoing configuration, an adjustment time from a time point at which a leading edge of the recording paper reaches the registration rollers until a time point at which transport of the recording paper by the registration rollers commences may be a time required for the leading edge of the recording paper to contact the registration rollers and be made parallel to the registration rollers.

In this case, the adjustment time is set to a time required for the leading edge of the recording paper to contact the registration rollers and be made parallel to the registration rollers. In this way, slanted transport of the recording paper is corrected, and the recording paper is transported in a direction orthogonal to the registration rollers.

Next, with another paper transport path of an image forming apparatus according to the present invention, a recording paper is transported from a paper feed portion through a paper transport path to registration rollers and the recording paper is further transported to a print processing portion via the registration rollers such that printing is carried out on the recording paper by the print processing portion, and at least a part of the paper transport path on an upstream side from the registration rollers in a transport direction of the recording paper is controlled to switch between either a main transport path or a short transport path, which is shorter than the main transport path, such that the recording paper is guided to the registration rollers through either of the main transport path or the short transport path.

With the present invention, either the main transport path or the short transport path, which is shorter than the main transport path, is switched and arranged on an upstream side from the registration rollers such that the recording paper is guided to the registration rollers through either of the main transport path or the short transport path. When the short transport path is set, the short transport path is shorter than the main transport path and therefore the transport distance of the recording paper until reaching the registration rollers is shortened. For this reason, when a preceding recording paper is transported through the main transport path and, following this, a succeeding recording paper is transported through the short transport path, the succeeding recording paper is transported more quickly with respect to the preceding recording paper and the distance of spacing between the trailing edge of the preceding recording paper and the leading edge of the succeeding recording paper becomes shorter.

Furthermore, in the foregoing configuration, when a distance of spacing between a trailing edge of a preceding recording paper and a leading edge of a succeeding recording paper exceeds a prescribed spacing in a state in which a plurality of sheets of recording paper are being transported successively, the short transport path may be used as at least a part of the paper transport path, and the main transport path may be used as at least a part of the paper transport path when a distance of spacing between a trailing edge and a leading edge of the recording papers is not greater than the prescribed spacing.

In this case, when the distance of spacing between the recording papers being transported successively becomes wider than the prescribed spacing, the distance of spacing between the recording papers can be changed to be shorter by transporting the succeeding recording paper through the short transport path.

BRIEF DESCRIPTION OF THE DRAWINGS

FIG. 7(*a*) illustrates relative positions of a plurality of sheets of recording paper being transported successively and FIG. 7(*b*) is a table showing selection control and acceleration/deceleration control of the main transport path and the extended transport path for FIG. 7(*a*).

FIG. 8(*a*) illustrates relative positions of a plurality of sheets of recording paper being transported successively and FIG. 8(*b*) is a table showing deceleration control for FIG. 8(*a*).

FIG. 9(*a*) illustrates relative positions of a plurality of sheets of recording paper being transported successively and FIG. 9(*b*) is a table showing acceleration control for FIG. 9(*a*).

DESCRIPTION OF THE PREFERRED EMBODIMENTS

Hereinafter, an embodiment of the present invention is described in detail with reference to the accompanying drawings.

Figure 1:
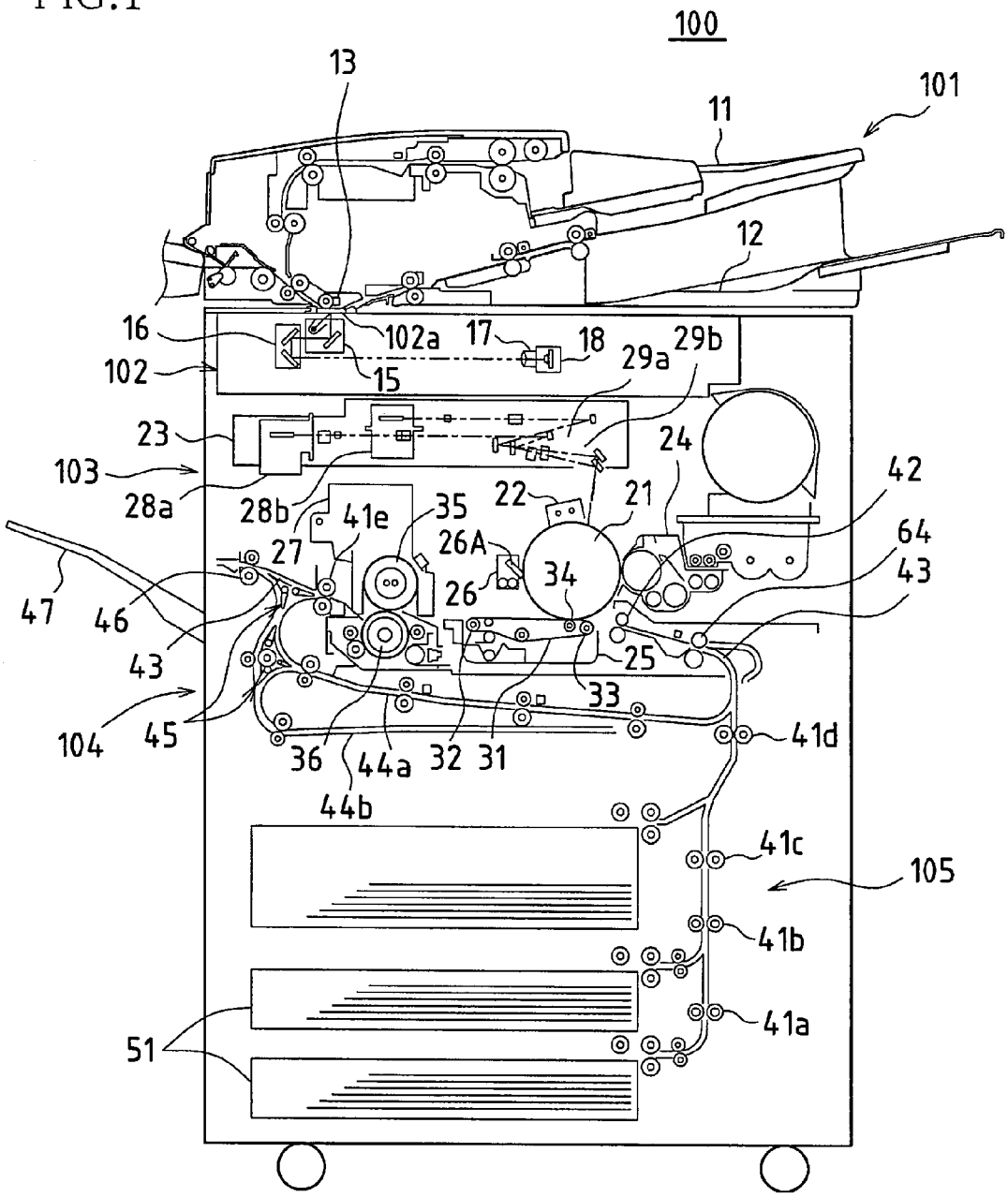
FIG. 1 is a cross-sectional view showing one embodiment of an image forming apparatus according to the present invention.

FIG. 1 is a cross-sectional view showing one embodiment of an image forming apparatus according to the present invention. An image forming apparatus 100 obtains image data that has been read from an original paper or obtains image data that has been received from outside, and forms a monochrome image indicated by the image data on a recording paper, and its structure can be broadly divided into an original paper transport portion (ADF) 101, an image reading portion 102, a print portion 103, a recording paper transport portion 104, and a paper feed portion 105.

When at least one sheet of an original paper is set in an original setting tray 11 in the original paper transport portion 101, the original paper is picked up and transported from the original setting tray 11 sheet by sheet, and the original paper is guided to and made to pass through an original reading window 102*a* of the image reading portion 102, then the original paper is discharged to a discharge tray 12.

A CIS (contact image sensor) 13 is arranged above the original reading window 102*a*. When the original paper passes over the original reading window 102*a*, the CIS 13 repetitively reads in a main scanning direction an image of a back side of the original paper and outputs image data that indicates an image of the back side of the original paper.

Furthermore, when the original paper passes over the original reading window 102*a*, the image reading portion 102 uses a lamp of a first scanning unit 15 to expose the surface of the original paper, then guides reflected light from the surface of the original paper to an imaging lens 17 using mirrors of the first and a second scanning unit 15 and 16, and an image of the surface of the original paper is imaged onto a CCD (charge coupled device) 18 by the imaging lens 17. The CCD 18 repetitively reads in a main scanning direction an image of the surface of the original paper and outputs image data that indicates an image of the surface of the original paper.

Further still, in a case where the original paper is placed onto a platen glass on an upper surface of the image reading portion 102, the first and second scanning units 15 and 16 are caused to move while maintaining a predetermined velocity relationship such that the surface of the original paper on the platen glass is exposed by the first scanning unit 15 and reflected light from the surface of the original paper is guided to the imaging lens 17 by the first and second scanning units 15 and 16, and an image of the surface of the original paper is imaged onto the CCD 18 by the imaging lens 17.

Image data that has been outputted from the CIS 13 or the CCD 18 undergoes various types of image processing by a control circuit such as a microcomputer and is then outputted to the print portion 103.

The print portion 103 is for recording an original, which is represented by image data, onto paper, and is provided with components such as a photosensitive drum 21, a charging unit 22, an optical writing unit 23, a development unit 24, a transfer unit 25, a cleaning unit 26, and a fixing apparatus 27.

The photosensitive drum 21 is an organic photosensitive structure having a surface layer made of an organic photoconductive material, and rotates in one direction and after its surface is cleaned by the cleaning unit 26, its surface is uniformly charged by the charging unit 22. The charging unit 22 may be a charger type unit or may be a roller type or brush type unit that makes contact with the photosensitive drum 21.

The optical writing unit 23 is a laser scanning unit (LSU) provided with two laser irradiation portions 28*a* and 28*b*, and two mirror groups 29*a* and 29*b*. The optical writing unit 23 inputs image data and emits laser beams corresponding to the image data from the laser irradiation portions 28*a* and 28*b* respectively, then these laser beams are irradiated on the photosensitive drum 21 via the mirror groups 29*a* and 29*b* so that the uniformly charged surface of the photosensitive drum 21 is exposed so as to form an electrostatic latent image on the surface of the photosensitive drum 21.

To support high speed print processing, the optical writing unit 23 employs a two beam system provided with the two laser irradiation portions 28*a* and 28*b* such that the irradiation timing is made faster and the load is decreased.

It should be noted that instead of the laser scanning unit, an EL writing head or an LED writing head in which light-emitting elements are lined up in an array may be used as the optical writing unit 23.

The development unit 24 supplies toner to the surface of the photosensitive drum 21 to develop the electrostatic latent image and form a toner image (also referred to as "visible image") on the surface of the photosensitive drum 21. The transfer unit 25 transfers the toner image on the surface of the photosensitive drum 21 to the recording paper that has been transported in by the paper transport portion 104. The fixing apparatus 27 applies heat and pressure to the recording paper to cause the toner image to fix onto the recording paper. After this, the recording paper is further transported and discharged to a discharge tray 47 by the paper transport portion 104. Furthermore, the cleaning unit 26 removes and collects toner that is residual on the surface of the photosensitive drum 21 after development and transfer.

Here, the transfer unit 25 is provided with such components as a transfer belt 31, a drive roller 32, an idler roller 33, and an elastic conductive roller 34, and the transfer belt 31 is caused to rotate while spanning the rollers 32 to 34 and other rollers in a tensioned state. The transfer belt 31 has a predetermined resistance value (for example, $1\times10^{9}$ to $1\times10^{13}$ Ω/cm) and transports a recording paper that has been placed on its surface. The elastic conductive roller 34 presses against the surface of the photosensitive drum 21 through the transfer belt 31 and the recording paper on the transfer belt 31 presses against the surface of the photosensitive drum 21. A transfer electric field of a polarity opposite to the charge of the toner image on the surface of the photosensitive drum 21 is applied to the elastic conductive roller 34, and the toner image on the surface of the photosensitive drum 21 is transferred to the recording paper on the transfer belt 31 due to the opposite polarity transfer electric field. For example, when the toner image has a charge of a negative (−) polarity, the elastic conductive roller 34 is subjected to a transfer electric field having a positive (+) polarity.

In the cleaning unit 26, a cleaning blade 26A presses against the surface of the photosensitive drum 21 to remove residual toner and paper dust from the surface of the photosensitive drum 21. Not all the toner image on the surface of the photosensitive drum 21 is transferred onto the recording paper and although it varies among transfer mechanisms, the transfer efficiency is generally said to be approximately 85% to 95%. On the other hand, when the recording paper is subjected to the transfer electric field, suspended matter on the surface of the recording paper (such as short fiber cellulose, filler, and bleaching agent) is charged to a polarity opposite to the transfer electric field and this charged suspended matter adheres to the surface of the photosensitive drum 21 to become extraneous matter referred to as "paper dust."

If residual toner and paper dust on the surface of the photosensitive drum 21 cannot be removed, then printing quality is reduced. For this reason, it is necessary to have cleaning of the surface of the photosensitive drum 21 by the cleaning unit 26.

The fixing apparatus 27 is provided with a hot roller 35 and a pressure roller 36. A pressure-applying member not shown in the drawings is arranged at both ends of the pressure roller 36 so that the pressure roller 36 is pressed into contact with the hot roller 35 with a predetermined pressure. When the recording paper is transported to a pressure-contact region (referred to as a nip region) between the hot roller 35 and the pressure roller 36, the unfixed toner image on the recording paper is subjected to thermal melting and pressure while the recording paper is being carried by the rollers 35 and 36 such that the toner image fixes to the recording paper.

The paper transport portion 104 is provided with components such as a plurality of pairs of transport rollers 41*a* to 41*e* for transporting the recording paper, a pair of pre-registration rollers 64, a pair of registration rollers 42, a paper transport path 43, reverse transport paths 44*a* and 44*b*, a plurality of branching claws 45, and a pair of discharge rollers 46.

In the paper transport path 43, the recording paper is taken in from the paper feed portion 105, then the recording paper is transported until the leading edge of the recording paper reaches the registration rollers 42. At this time the registration rollers 42 are being temporarily stopped, and therefore the leading edge of the recording paper reaches and contacts the registration rollers 42 and the recording paper flexes. Due to the elastic force of the flexed recording paper, the leading edge of the recording paper aligns parallel to the registration rollers 42. After this, rotation of the registration rollers 42 commences and the recording paper is transported by the registration rollers 42 to the transfer unit 25 of the print portion 103, then the recording paper is further transported by the discharge rollers 46 to the discharge tray 47.

Stopping and rotation of the registration rollers 42 can be achieved by switching on and off a clutch between the registration rollers 42 and their drive shafts or by switching on and off the motor that is the drive source of the registration rollers 42.

Furthermore, when an image is to be recorded to the back side of the recording paper also, the branching claws 45 are selectively switched so that the recording paper is guided from the paper transport path 43 into the reverse transport path 44*b*, then transport of the recording paper is caused to stop temporarily, and the branching claws 45 are again switched so that the recording paper is guided from the reverse transport path 44*b* into the reverse transport path 44*a*, and once the back side of the recording paper has been turned over the recording paper returns to the registration rollers 42 of the paper transport path 43 via the reverse transport path 44*a*.

This manner of transporting the recording paper is referred to as switchback transporting, and switchback transporting allows the back side of the recording paper to be turned over and at the same time switches the leading edge and the trailing edge of the recording paper. Consequently, when the recording paper is turned over and returned, the trailing edge of the recording paper makes contact with the registration rollers 42 such that the trailing edge of the recording paper aligns in parallel to the registration rollers 42, then the recording paper is transported from its trailing edge by the registration rollers 42 to the transfer unit 25 of the print portion 103 and printing is carried out on the back side of the recording paper, then the unfixed toner image on the back side of the recording paper is subjected to thermal melting and pressure by the nip region between the rollers 35 and 36 of the fixing apparatus 27 such that the toner image fixes onto the back side of the recording paper, after which the recording paper is transported to the discharge tray 47 by the discharge rollers 46.

Sensors that detect the position and the like of the recording paper are arranged in various locations in the paper transport path 43 and the reverse transport paths 44*a* and 44*b*, and the transport and positioning of the recording paper are carried out by drive controlling the transport rollers and the registration rollers based on the positions of the recording paper detected by the various sensors.

The paper feed portion 105 is provided with a plurality of paper supply cassettes 51. Each of the paper supply cassettes 51 is a tray for storing recording paper and these are provided below the image forming apparatus 100. Furthermore, each of the paper supply cassettes 51 is provided with a pickup roller or the like for picking up the recording paper sheet by sheet and recording paper that has been picked up is fed to the paper transport path 43 of the paper transport portion 104.

Since the image forming apparatus 100 is aimed at high speed print processing, each of the paper supply cassettes 51 has a capacity capable of storing from 500 to 1,500 sheets of standard size recording papers.

The discharge tray 47 is arranged at a side face on the left side in FIG. 1. Instead of the discharge tray 47, configurations in which post processing devices of the recording paper (stapling, punching and the like) or a plurality of levels of discharge trays are arranged as options are also possible.

In the image forming apparatus 100 as above, the print processing speed is increased to improve the usefulness thereof. For example, when using A4 size recording paper, the transport speed of the recording paper is set to 100 sheets/min (a processing speed of 450 to 600 mm/sec).

Figure 2:
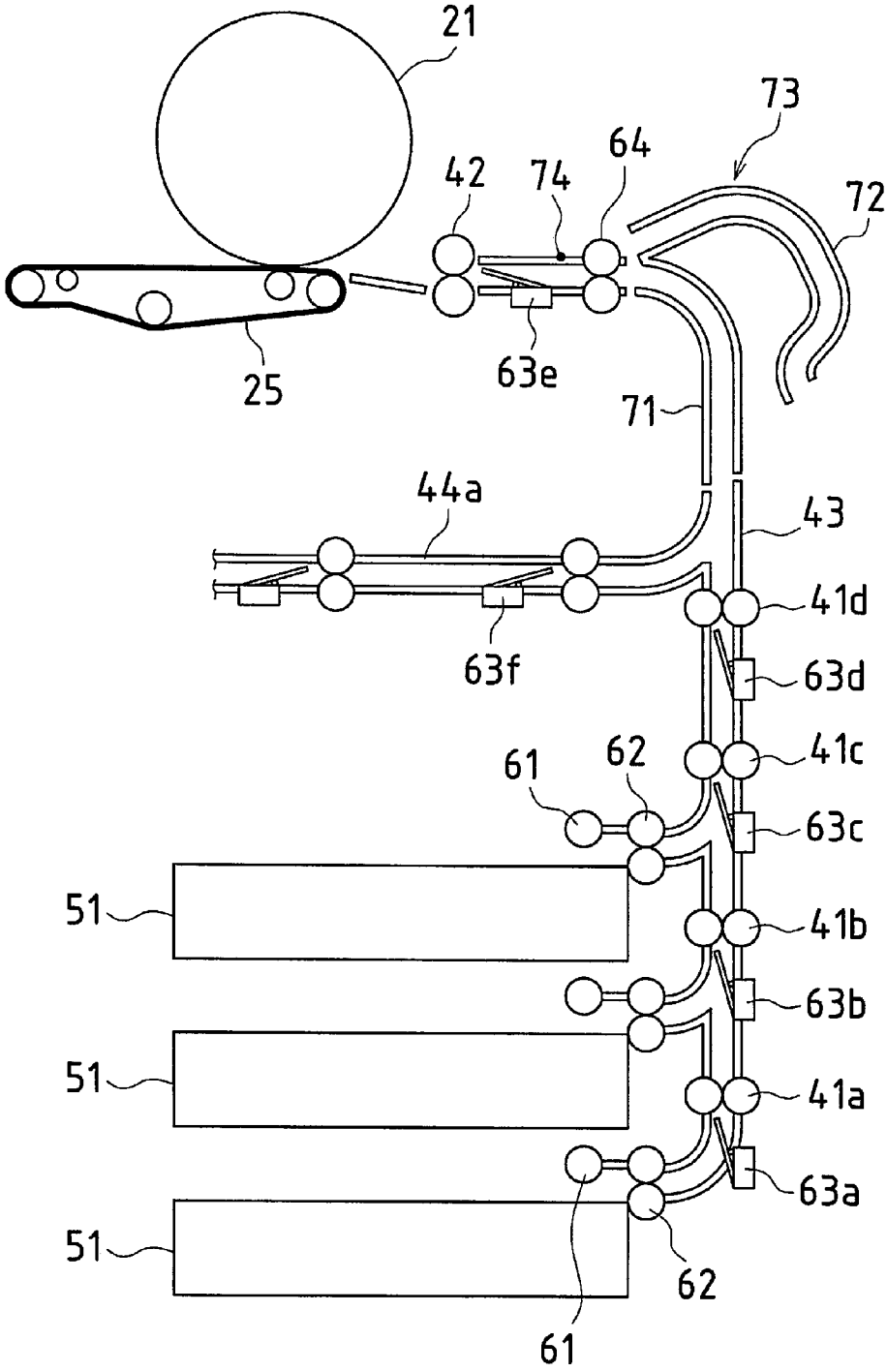
FIG. 2 is a lateral view showing a paper transport portion in the image forming apparatus of FIG. 1.

FIG. 2 shows an enlargement of the paper transport portion 104. As shown in FIG. 2, each of the paper supply cassettes 51 is provided with a pickup roller 61 and separator rollers 62, and the recording paper in the paper supply cassettes 51 is picked up by the pickup roller 61, then the recording paper is separated sheet by sheet by the separator rollers 62 and fed out to the paper transport path 43. Paper detection sensors 63*a* to 63*e* for detecting the leading edge and the trailing edge of the recording paper are arranged in a plurality of locations on the paper transport path 43, and the transport rollers 41*a* to 41*d*, the pre-registration rollers 64, and the registration rollers 42 undergo drive control based on detected timings of the leading edge and trailing edge of the recording paper by the paper detection sensors 63*a* to 63*e* to carry out transport of the recording paper by these rollers. When the leading edge of the recording paper contacts the registration rollers 42, the registration rollers 42 stop and the leading edge of the recording paper is pushed against the registration rollers 42 by the pre-registration rollers 64 such that the recording paper flexes, and due to an elastic force of the flexed recording paper, the leading edge of the recording paper aligns parallel to the registration rollers 42. Then transport of the recording paper by the registration rollers 42 commences so that the leading edge of the recording paper reaches the transfer unit 25 in timing with commencement of transfer of the toner image on the surface of the photosensitive drum 21.

Accordingly, an adjustment time is set from when transport of the recording paper is temporarily stopped immediately before the registration rollers 42 until transport recommences.

With the image forming apparatus 100 of the present embodiment, the above-mentioned adjustment time is gained by varying the transport speeds of the recording paper on the upstream side and downstream side of the registration rollers 42 in the transport direction of the recording paper. Specifically, the transport speed of the recording paper by the transport rollers 41*a* to 41*d* and the pre-registration rollers 64 on the upstream side of the registration rollers 42 is set approximately 1.5 to 2.5 times the print processing speed on the downstream side of the registration rollers 42 so that the timing of the recording paper reaching the registration rollers 42 is faster than the transport commencement timing by the registration rollers 42, thereby gaining adjustment time.

As mentioned earlier, the transport speed is set to a high speed of 100 sheets/min (a processing speed of 450 to 600 mm/sec) when printing with A4 size recording paper, and therefore the transport speed of the recording paper by the transport rollers 41*a* to 41*d* and the pre-registration rollers 64 on the upstream side of the registration rollers 42 is set to 600 to 1,500 mm/sec to gain adjustment time. And it is necessary not only for the transport rollers 41*a* to 41*d* and the pre-registration rollers 64, but also for the transport speed of the pickup roller 61 and the separator rollers 62 of the paper supply cassettes 51 to be set to 600 to 1,500 mm/sec.

Further still, since it is difficult to achieve high print processing speeds with only higher transport speeds of the recording paper, the distances of the spacing between preceding recording papers and succeeding recording papers, which are being transported successively, are made smaller. For example, the distance of spacing between the trailing edge of a preceding recording paper and the leading edge of a succeeding recording paper is set to approximately 50 to 100 mm.

In this regard, in a state where a plurality of sheets of recording paper are successively being picked up from the paper supply cassettes 51 and transported, the distance of spacing between the recording papers will not always be kept constant. For example, when the pickup roller 61 slips on the surface of the recording paper and the timing for picking up the recording paper is delayed, the distance of spacing between the recording papers is increased. Furthermore, when a preceding recording paper is picked up by the pickup roller 61, if the succeeding recording paper stacked thereunder is dragged out by the preceding recording paper, then the leading edge of the succeeding recording paper will stay extended to a position of the separator rollers 62 even if the succeeding recording paper is pulled apart from the preceding recording paper by the separator rollers 62, and therefore the succeeding recording paper will be picked up in a state in which it is close to the preceding recording paper, thereby reducing the distance of spacing between the recording papers.

Performing variable speed control on the transport speed by the transport rollers 41*a* to 41*d* and the pre-registration rollers 64 is conceivable as a method for adjusting the distance of spacing between the recording papers. For example, in a case where the distance of spacing between a preceding recording paper and a succeeding recording paper has increased, if the transport speed of the succeeding recording paper is accelerated while the preceding recording paper is being temporarily stopped immediately before the registration rollers 42, then the distance of spacing between the recording papers can be decreased. Furthermore, in a case where the distance of spacing between a preceding recording paper and a succeeding recording paper has decreased, if the transport speed of the succeeding recording paper is decelerated while the preceding recording paper is being temporarily stopped immediately before the registration rollers 42, then the distance of spacing between the recording papers can be increased.

However, it is not easy to perform variable speed control on the transport speed by the transport rollers 41*a* to 41*d* and the pre-registration rollers 64, and control of the transport speed becomes complicated and difficult if control is to be carried out for all of acceleration, deceleration, and fixed speed. Furthermore, in a case of performing either acceleration or deceleration, it is not sufficient to only control the speed of a single recording paper, for if another recording paper is transported to the paper transport path 43 or has already been pulled out by the separator rollers 62 while speed control is being performed on the single recording paper, then it is necessary to perform control on the speed of this other recording paper also, and transport speed control is complicated due to this also.

Accordingly, in the image forming apparatus 100 of the present embodiment, a transport path switching unit 73 is provided as a part of the paper transport path 43 between the transport rollers 41*d* and the pre-registration rollers 64, and the total length of the paper transport path 43 is varied by interposing either a main transport path 71 or an extended transport path 72 as a part of the paper transport path 43 between the transport rollers 41*d* and the pre-registration rollers 64, and at the same time the distance of spacing between the recording papers is adjusted by performing fixed speed and acceleration control on the transport speed of the recording papers on the upstream side of the registration rollers 42.

Figure 3:
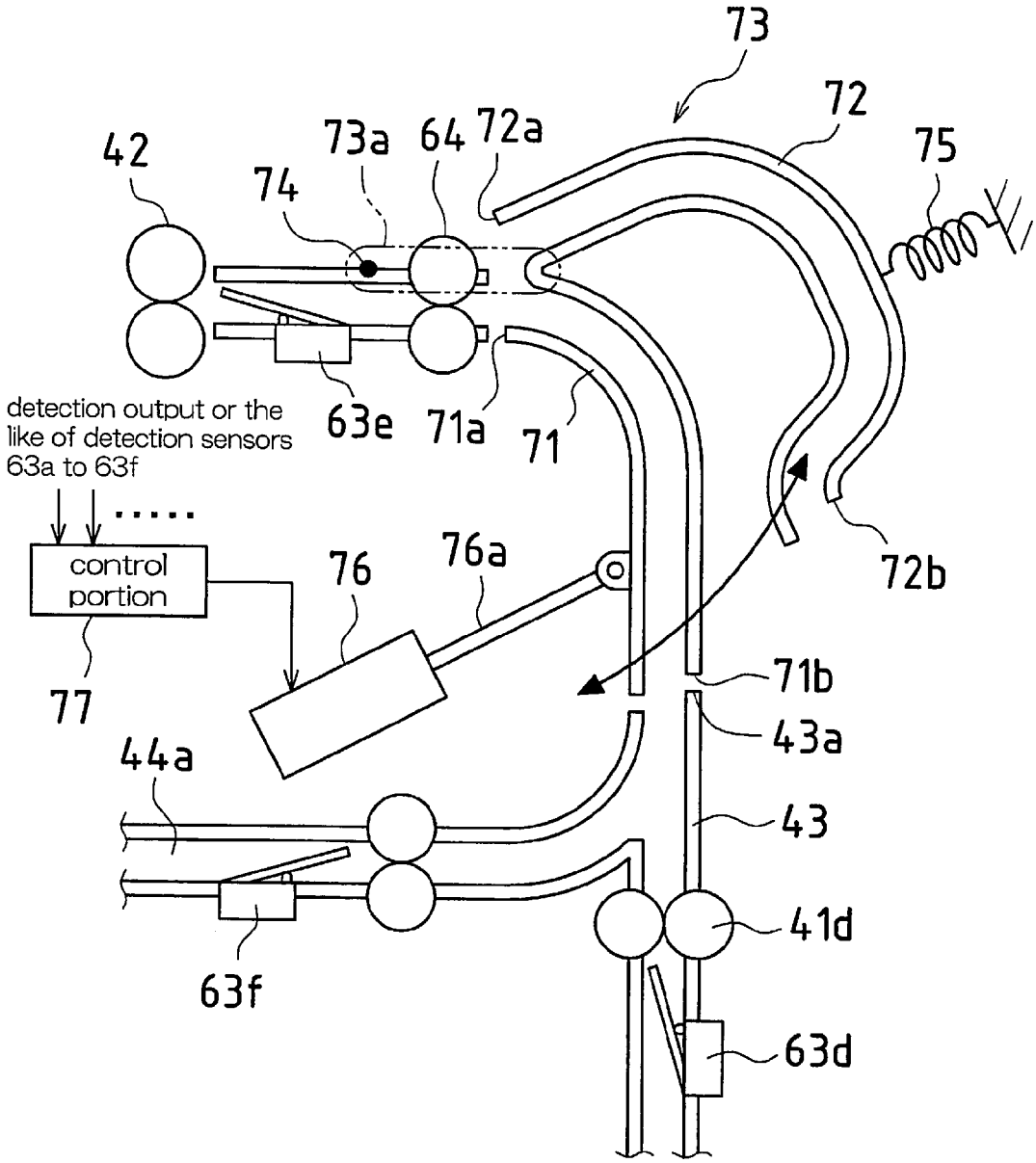
FIG. 3 is a cross-sectional view showing an enlargement of a vicinity of a transport path switching unit of the paper transport path of FIG. 2.
Figure 4:
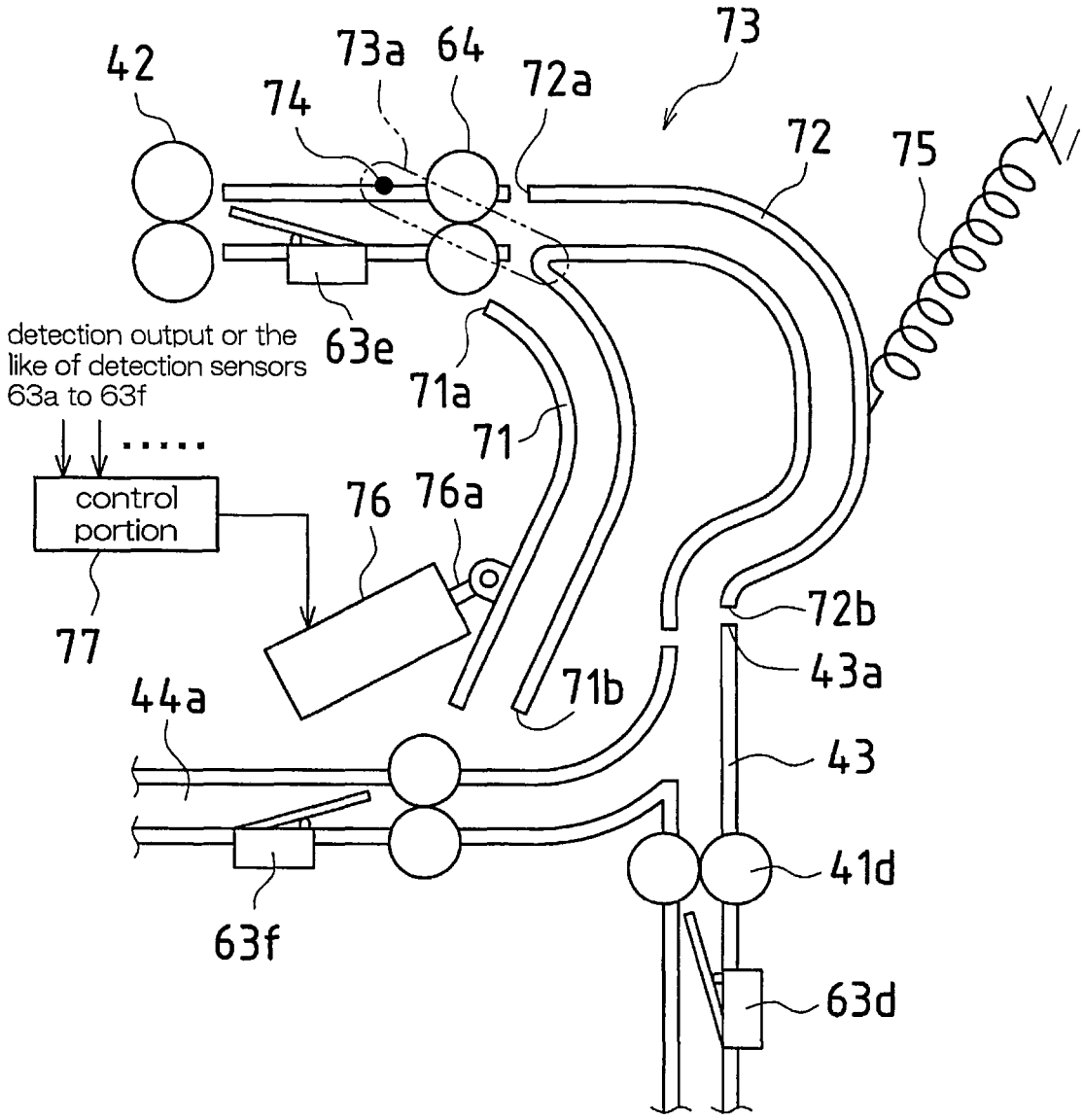
FIG. 4 shows a switching operation of the transport path switching unit of FIG. 3.

FIG. 3 is a lateral view showing an enlargement of the transport path switching unit 73. In the transport path switching unit 73, outlets 71*a* and 72*a* of the main transport path 71 and the extended transport path 72 are joined in a V-shape such that the main transport path 71 and the extended transport path 72 are an integrated component, and the transport path switching unit 73 is rotatably supported a support shaft 74 on a downstream side from the outlets 71*a* and 72*a* of the main transport path 71 and the extended transport path 72. By rotating the transport path switching unit 73 counterclockwise around the support shaft 74, the main transport path 71 can be interposed and positioned as the part of the paper transport path 43 between the transport rollers 41*d* and the pre-registration rollers 64, and moreover, as shown in FIG. 4, by rotating the transport path switching unit 73 clockwise around the support shaft 74, the extended transport path 72 can be interposed and positioned as the part of the paper transport path 43 between the transport rollers 41*d* and the pre-registration rollers 64.

In a same manner as the paper transport path 43, both the main transport path 71 and the extended transport path 72 have a width (the width across the vertical direction in FIG. 3) sufficiently wider than the recording paper and can guide an entire recording paper.

The support shaft 74 is arranged on an end of an arm 73*a* that is secured to both sides of the transport path switching unit 73. Ends of a coil spring 75 are connected to a side wall of the extended transport path 72 and the apparatus main unit, and the transport path switching unit 73 is pulled counterclockwise around the support shaft 74 by the coil spring 75. Furthermore, a plunger 76*a* of a solenoid 76 is coupled to a side wall of the main transport path 71.

Energization control of the solenoid 76 is performed by a control portion 77. When the solenoid 76 is in a de-energized state, the transport path switching unit 73 is rotationally moved counterclockwise around the support shaft 74 by an elastic force of the coil spring 75 such that edges of an inlet 71*b* of the main transport path 71 abut edges of a switching opening 43*a* of the paper transport path 43, and the inlet 71*b* of the main transport path 71 corresponds to the switching opening 43*a* of the paper transport path 43 such that the main transport path 71 is interposed between the transport rollers 41*d* and the pre-registration rollers 64.

Furthermore, when the solenoid 76 is energized by the control portion 77 as shown in FIG. 4, the plunger 76*a* is pulled into the main body of the solenoid 76 such that the elastic force of the coil spring 75 is opposed and the transport path switching unit 73 is rotationally moved clockwise around the support shaft 74, and edges of an inlet 72*b* of the extended transport path 72 abut edges of the switching opening 43*a* of the paper transport path 43, and the inlet 72*b* of the extended transport path 72 corresponds to the switching opening 43*a* of the paper transport path 43 such that the extended transport path 72 is interposed between the transport rollers 41*d* and the pre-registration rollers 64.

The extended transport path 72 is greatly curved and its length (transport length) is greater than the main transport path 71. Accordingly, when the extended transport path 72 is positioned interposed between the transport rollers 41*d* and the pre-registration rollers 64, the length (transport length) of the paper transport path 43 overall is longer than when the main transport path 71 is positioned interposed.

A difference in length (distance difference) between the main transport path 71 and the extended transport path 72 is set not less than a prescribed spacing that is set between recording papers when a largest size recording paper printable by the image forming apparatus 100 is being used. Ordinarily, the prescribed spacing between recording papers varies depending on the size of the recording paper and is set wider for larger sizes of recording paper. For example, when the largest size printable by the image forming apparatus 100 is A3 size and the prescribed spacing between recording papers that is set when using A3 size recording papers is 100 mm, the difference in length between the main transport path 71 and the extended transport path 72 is set to 100 mm or more. In this way, even when the distance of spacing between largest size recording papers is zero, the distance of spacing between recording papers can be increased to the largest prescribed spacing merely by sending the succeeding recording paper through the extended transport path 72 as is described later.

Furthermore, the control portion 77 inputs the detection output from the paper detection sensors 63*a* to 63*f* and, based on the detected timings of the leading edge and trailing edge of the recording paper by the paper detection sensors 63*a* to 63*f*, performs drive control of the pickup roller 61, the separator rollers 62, the transport rollers 41*a* to 41*d*, and the pre-registration rollers 64 while determining such factors as the position and transport speed of the recording paper so that such factors as the position and transport speed of the recording paper are controlled.

Figure 5:
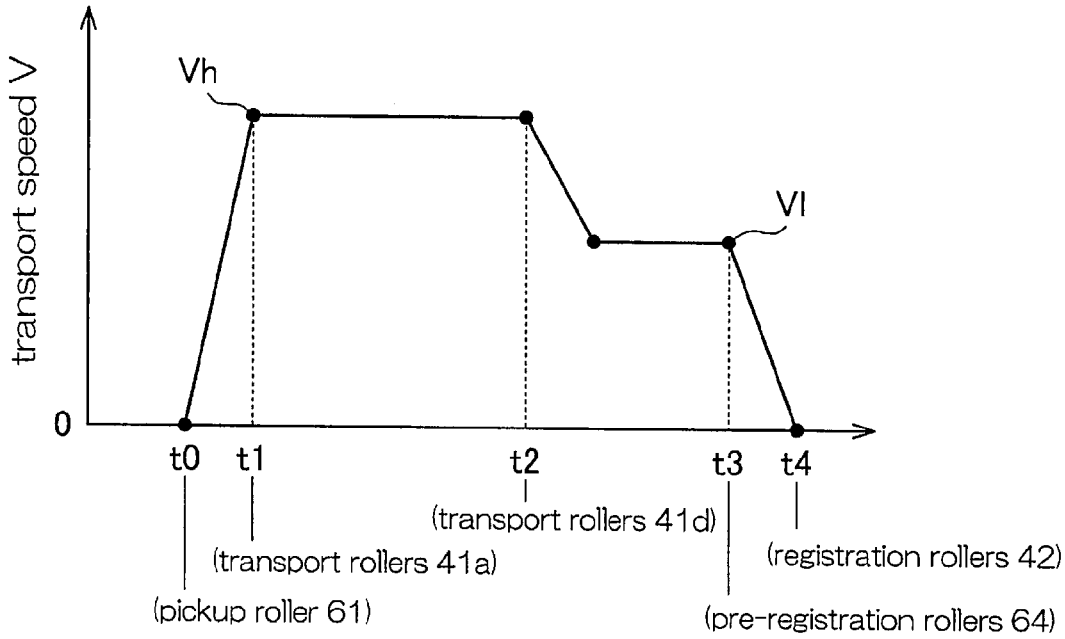
FIG. 5 is a graph showing change in transport speed of the recording paper from the pickup roller of the paper supply cassette to the registration rollers in the paper transport portion of FIG. 2.

A graph in FIG. 5 shows change in transport speed of the recording paper from the pickup roller 61 of the paper supply cassettes 51 to the registration rollers 42. As shown in the graph, in a period from a time point t0 at which the recording paper is picked up by the pickup roller 61 until a time point t1, a transport speed v is raised rapidly and the recording paper undergoes acceleration transport. And in a period from the time point t1 to a time point t2, the transport speed is a fixed high speed vh. Further still, in a period from the time point t2 to a time point t3, the transport speed is reduced to a semi-high speed v1, and from the time point t3 onward, the transport speed decelerates to substantially zero.

Here, the time point t0 is the time point at which the recording paper is picked up by the pickup roller 61, the time point t1 is the time point at which the recording paper reaches the transport rollers 41*a* (which is in the case of the lowest level paper supply cassette 51 shown in FIG. 2; and the transport rollers 41*b* and 41*c* in the case of the other paper supply cassettes 51, which also applies in the following), the time point t2 the time point at which the recording paper reaches the transport rollers 41*d*, and the time point t3 is the time point at which the recording paper reaches the pre-registration rollers 64. Accordingly, the recording paper undergoes acceleration transport from the pickup roller 61 to immediately before the transport rollers 41*a*, and following this the recording paper is transported at the high speed vh from the transport rollers 41*a* to immediately before the transport rollers 41*d*, and further still the recording paper is transported at the semi-high speed v1 from the transport rollers 41*d* to immediately before the pre-registration rollers 64, after which the recording paper undergoes deceleration transport so as to substantially stop until reaching the registration rollers 42. Further still, from the registration rollers 42 to the transfer unit 25 the recording paper is transported at a transport speed lower than the semi-high speed v1 and print processing is carried out.

The semi-high speed v1 from the transport rollers 41*d* to immediately before the pre-registration rollers 64 corresponds to the transport speed of either the main transport path 71 and the extended transport path 72.

Next, in this configuration, in a state where the main transport path 71 is interposed between the transport rollers 41*d* and the pre-registration rollers 64, transport of the recording paper and print processing commences, then A4 size sheets of recording paper are pulled out from the paper supply cassettes 51 at 100 sheets/min for example, and successively transported through the paper transport path 43 such that print processing onto the recording papers is carried out sheet by sheet. At this time, the control portion 77 performs drive control of the pickup roller 61, the separator rollers 62, the transport rollers 41*a* to 41*d*, and the pre-registration rollers 64 while determining the transport speed of the recording paper based on the detected timings of the leading edge and trailing edge of the recording paper by the paper detection sensors 63*a* to 63*e* so that the transport speed of the recording paper is controlled as shown in the graph of FIG. 5.

At the same time, the control portion 77 determines a time interval between a detected timing of a trailing edge of a preceding recording paper and a detected timing of a leading edge of a succeeding recording paper by the paper detection sensor 63*d* immediately before the transport rollers 41*d*, and obtains a transport speed of the transport rollers 41*d* (semi-high speed v1), then determines the distance of spacing between the trailing edge of the preceding recording paper and the leading edge of the succeeding recording paper from the time interval and the semi-high speed v1, and monitors this distance of spacing.

The control portion 77 then compares the distance of spacing with the prescribed spacing for when transporting A4 size recording paper, and if it determines that the distance of spacing matches the prescribes spacing, it continues to perform unchanged drive control on the pickup roller 61, the separator rollers 62, the transport rollers 41*a* to 41*d*, and the pre-registration rollers 64 such that the transport speed of the recording paper is maintained.

And if the control portion 77 determines that the distance of spacing between the preceding recording paper and the succeeding recording paper is shorter than the prescribed spacing, then it energizes the solenoid 76 at a timing immediately after detection of a leading edge of a succeeding recording paper P2 by the paper detection sensor 63*d* and at which the leading edge of the succeeding recording paper is being transported by the transport rollers 41*d* such that the transport path switching unit 73 rotationally moves and instead of the main transport path 71, the extended transport path 72 is interposed between the transport rollers 41*d* and the pre-registration rollers 64. In this way, the succeeding recording paper is passed through the extended transport path 72 to be transported to the pre-registration rollers 64.

At this time, the leading edge of the preceding recording paper contacts and aligns with the registration rollers 42 while its trailing edge is discharged from the main transport path 71.

Further still, based on the difference of distance between the main transport path 71 and the extended transport path 72, the prescribed spacing between the preceding recording paper and the succeeding recording paper, and the distance of spacing between the preceding recording paper and the succeeding recording paper, the control portion 77 determines a transport speed for the recording paper in the extended transport path 72 so as to correct the distance of spacing to the prescribed distance, then performs drive control on the transport rollers 41*d* such that the transport speed in the extended transport path 72 undergoes adjustment control to the thus-determined transport speed.

Figure 6:
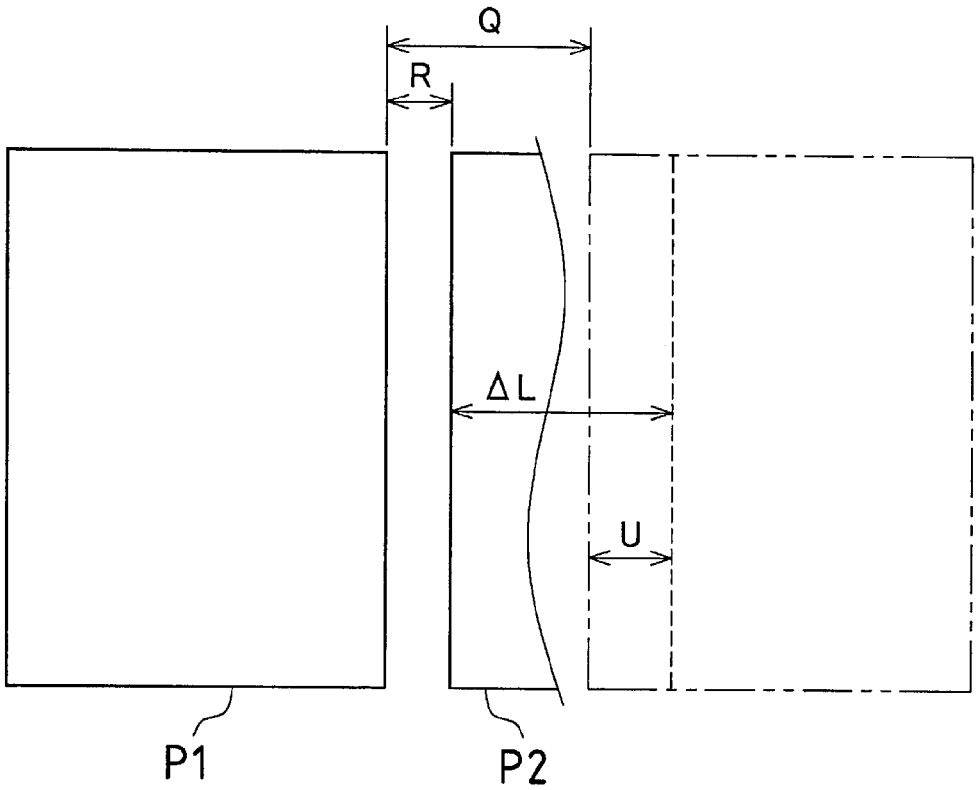
FIG. 6 is used for describing a switching operation of the transport path switching unit of FIG. 3 and an effect of acceleration control on the transport speed.

For example, if a distance of spacing R between a succeeding recording paper P1 and a succeeding recording paper P2 is less than an intended prescribed spacing Q as shown in FIG. 6 at a timing at which the leading edge of the succeeding recording paper is detected by the paper detection sensor 63*d*, then the extended transport path 72 is arranged interposed and the succeeding recording paper P2 is transported passing through the extended transport path 72.

Supposing that at this time the transport speed of the succeeding recording paper P2 in the extended transport path 72 was the same as the transport speed of the preceding recording paper P1 in the main transport path 71, then the distance of spacing R between the preceding recording paper P1 and the succeeding recording paper P2 would lengthen by a length difference ΔL between the main transport path 71 and the extended transport path 72 as shown in FIG. 6.

However, since the length difference ΔL is set sufficiently long, when the distance of spacing R between the preceding recording paper P1 and the succeeding recording paper P2 is increased by this length difference ΔL, the distance of spacing R is excessively extended and becomes undesirably wider than the intended prescribed spacing Q.

For this reason, the control portion 77 performs drive control on the transport rollers 41*d* to perform acceleration control on the transport speed in the extended transport path 72 and the distance of spacing R between the preceding recording paper P1 and the succeeding recording paper P2 is matched to the intended prescribed spacing Q.

The transport speed in the extended transport path 72 is accelerated so that while the succeeding recording paper 2 passes through the extended transport path 72, the leading edge of the succeeding recording paper P2 is brought closer to the trailing edge of the preceding recording paper P1 by a distance U (U=(R+ΔL)−Q) as shown in FIG. 6, and the distance of spacing R becomes the intended prescribed spacing Q.

In this way, the distance of spacing between the preceding recording paper and the succeeding recording paper is increased to the prescribed spacing while the succeeding recording paper passes through the extended transport path 72, and as a result an adjustment time from the time point at which the leading edge of the succeeding recording paper reaches the registration rollers 42 until the time point at which transport of the succeeding recording paper by the registration rollers 42 commences is ensured when the leading edge of the succeeding recording paper contacts the registration rollers 42.

FIG. 7(*a*) illustrates relative positions of a first preceding recording paper P1, a second succeeding recording paper P2, and third to fifth recording papers P3 to P5. Furthermore, FIG. 7(*b*) is a table showing selection control and acceleration/deceleration control of the main transport path 71 and the extended transport path 72 for each of the recording papers P1 to P5 in FIG. 7(*a*). It should be noted that a recording paper P0 is a recording paper transported before the preceding recording paper P1.

Here, the distance of spacing R between the preceding recording paper P1 and the succeeding recording paper P2 is narrow, and from the succeeding recording paper P2 onward the distance of spacing between the recording papers is maintained at the prescribed spacing Q. For this reason, it is necessary to increase only the distance of spacing R between the preceding recording paper P1 and the succeeding recording paper P2.

In this case, a switch is carried out from the main transport path 71 to the extended transport path 72 at a timing immediately after detection of the leading edge of the succeeding recording paper P2 by the paper detection sensor 63*d* and at which the leading edge of the succeeding recording paper P2 is being transported by the transport rollers 41*d* such that the extended transport path 72 is interposed between the transport rollers 41*d* and the pre-registration rollers 64 and the succeeding recording paper P2 is caused to pass through the extended transport path 72, and acceleration control is performed on the transport speed of the succeeding recording paper P2 in the extended transport path 72 by performing drive control on the transport rollers 41*d*. In this way, the distance of spacing R between the preceding recording paper P1 and the succeeding recording paper P2 is adjusted so as to match the intended prescribed spacing Q.

Thereafter, if the third and fourth recording papers P3 and P4 are also caused to pass through the extended transport path 72 and the transport speed in the extended transport path 72 is maintained in the same manner, the distance of spacing between the succeeding recording paper P2 and the third recording paper P3 will be maintained at the prescribed spacing Q, and the distance of spacing between the third and fourth recording papers P3 and P4 also will be maintained at the prescribed spacing Q without changing the relative positions of the third and fourth recording papers P3 and P4 to the second succeeding recording paper P2.

Further still, in regard to the fifth recording paper P5, the distance of spacing between it and the fourth recording paper P4 can be set to the prescribed spacing Q merely by delaying the timing of pulling out the fifth recording paper P5 from the paper supply cassettes 51. Furthermore, a switch is carried out from the extended transport path 72 to the main transport path 71 at a timing immediately after detection of the leading edge of the fifth recording paper P5 by the paper detection sensor 63*d* and at which the leading edge of the recording paper P5 is being transported by the transport rollers 41*d* such that the main transport path 71 is interposed between the transport rollers 41*d* and the pre-registration rollers 64 and the recording paper P5 is caused to pass through the main transport path 71, and the transport rollers 41*d* are returned to their original transport speed.

As a result, the distance of spacing R between the preceding recording paper P1 and the succeeding recording paper P2 is corrected to the prescribed spacing Q, and from the succeeding recording paper P2 onward the distance of spacing between the recording papers is maintained at the prescribed spacing Q.

In other words, when the distance of spacing R between a preceding recording paper and a succeeding recording paper becomes narrow, a switch is made from the main transport path 71 to the extended transport path 72 such that the succeeding recording paper passes through the extended transport path 72, and acceleration control is performed on the transport speed of the succeeding recording paper by the transport rollers 41*d* such that the distance of spacing R between the preceding recording paper and the succeeding recording paper is corrected to the prescribed spacing Q, then the third and fourth recording papers are also passed through the extended transport path and the distance of spacing between the recording papers is maintained, and the timing of picking out from the paper supply cassettes 51 after that is delayed and the distance of spacing between the fourth and fifth recording papers is set to the prescribed spacing Q, then a switch is made from the extended transport path 72 to the main transport path 71 and the transport speed of the transport rollers 41*d* is returned to their original speed.

In contrast to this, if the extended transport path 72 is not used and the length of the paper transport path 43 is fixed such that the distance of spacing between the preceding recording paper and the succeeding recording paper is returned to the prescribed distance merely by performing deceleration control on the transport speed of each of the transport rollers 41*a* to 41*d*, controlling the transport speed becomes complicated and difficult as shown in FIGS. 8(*a*) and 8(*b*).

FIG. 8(*a*) shows relative positions of recording papers P1 to P5 equivalent to FIG. 7(*a*), and FIG. 8(*b*) is a table showing deceleration control in regard to the recording papers P1 to P5 in FIG. 8(*a*). It should be noted that a recording paper P0 is a recording paper transported before the preceding recording paper P1.

Here, since the distance of spacing R between the recording papers P1 and P2 is narrower than the prescribed spacing Q, the distance of spacing R between the preceding recording paper P1 and the succeeding recording paper P2 is widened so as to match the intended prescribed spacing Q by performing deceleration control on the transport speed of the recording paper P2 by performing drive control on the transport rollers 41*d*.

Then, since the third and fourth recording papers P3 and P4 are being transported in the paper transport path 43 or already being pulled out by the separator rollers 62, their transport speeds also undergo deceleration control according to the delay of the succeeding recording paper P2 so that the distances of spacing for the recording papers P2 to P4 change to the prescribed spacing Q.

Further still, in regard to the fifth recording paper P5, the distance of spacing between it and the fourth recording paper P4 can be returned to the prescribed spacing Q merely by controlling the timing of pulling out the fifth recording paper P5 from the paper supply cassettes 51, and therefore the transport speed of the recording papers is returned to its original speed.

Consequently, when adjusting the distance of spacing between a preceding recording paper and a succeeding recording paper to the prescribed distance only by performing deceleration control on the transport speed of the transport rollers 41*a* to 41*d*, it is necessary to control not only the transport speed of the succeeding recording paper but also the transport speed of the third and fourth recording papers, such that controlling the transport speeds becomes complicated and difficult.

Next, suppose the distance of spacing between a preceding recording paper and a succeeding recording paper is longer than the prescribed spacing. In this case, the control portion 77 determines that the distance of spacing has become longer than the prescribed spacing at a timing at which the leading edge of the succeeding recording paper is detected by the detection sensor 63*d*, and carries out acceleration control of the transport speeds of the transport rollers 41*a* to 41*d* as shown in FIGS. 9(*a*) and 9(*b*) while the main transport path 71 remains as it is interposed between the transport rollers 41*d* and the pre-registration rollers 64, that is, without changing the length of the paper transport path 43, thereby controlling the distance of spacing between the preceding recording paper and the succeeding recording paper to the prescribed spacing.

FIG. 9(*a*) shows relative positions of recording papers P1 to P5, and FIG. 9(*b*) is a table showing acceleration control in regard to the recording papers P1 to P5 in FIG. 9(*a*). It should be noted that the recording paper P0 is a recording paper transported before the preceding recording paper P1.

Here, since the distance of spacing R between the recording papers P1 and P2 is wider than the prescribed spacing Q, a distance of spacing RI between the preceding recording paper P1 and the succeeding recording paper P2 is narrowed so as to match the intended prescribed spacing Q by performing acceleration control on the transport speed of the recording paper P2 by performing drive control on the transport rollers 41*d*.

Then, since the third and fourth recording papers P3 and P4 are also being transported in the paper transport path 43 or already being pulled out by the pickup roller 61, their transport speeds also undergo acceleration control following the succeeding recording paper P2 so that the distances of spacing for the recording papers P2 to P4 change to the prescribed spacing Q.

Further still, in regard to the fifth recording paper P5, the distance of spacing between it and the fourth recording paper P4 can be returned to the prescribed spacing Q merely by controlling the timing of pulling out the fifth recording paper P5 from the paper supply cassettes 51, and therefore the transport speed of the recording papers by the transport rollers 41*d* is returned to its original speed.

Consequently, when the distance of spacing between the preceding recording paper and the succeeding recording paper is longer than the prescribed spacing, the distance of spacing between the preceding recording paper and the succeeding recording paper is adjusted to the prescribed distance only by performing acceleration control for the succeeding recording paper, but it is necessary to control the transport speed not only for the succeeding recording paper but also for the third and fourth recording papers.

Note that compared to the deceleration control shown in FIG. 8(*b*), the acceleration control shown in FIG. 9(*b*) is easier.

Figure 10:
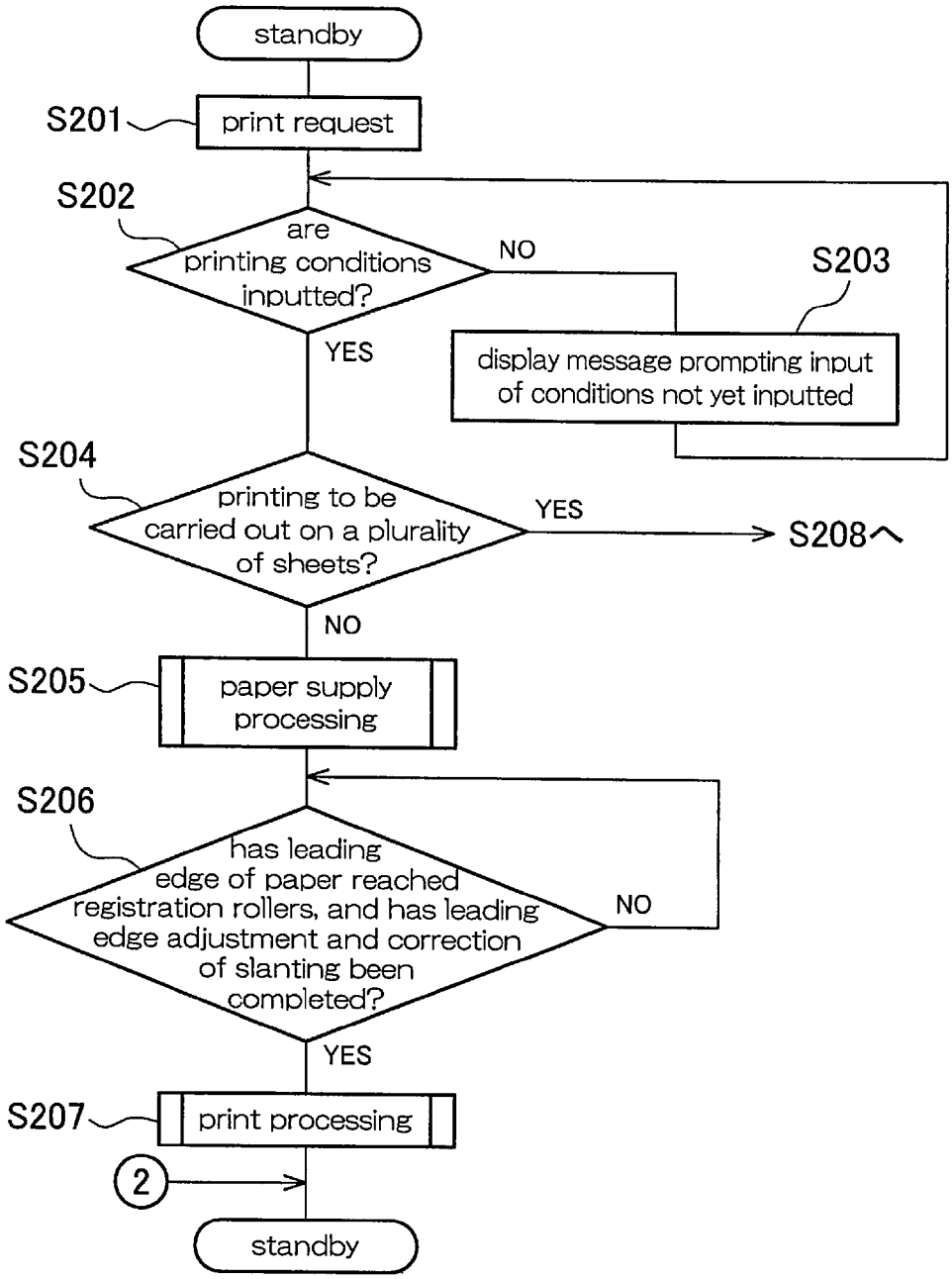
FIG. 10 is a flowchart showing a control process for adjusting and maintaining to the prescribed spacing the distance of spacing between the recording papers in the image forming apparatus of FIG. 1.
Figure 11:
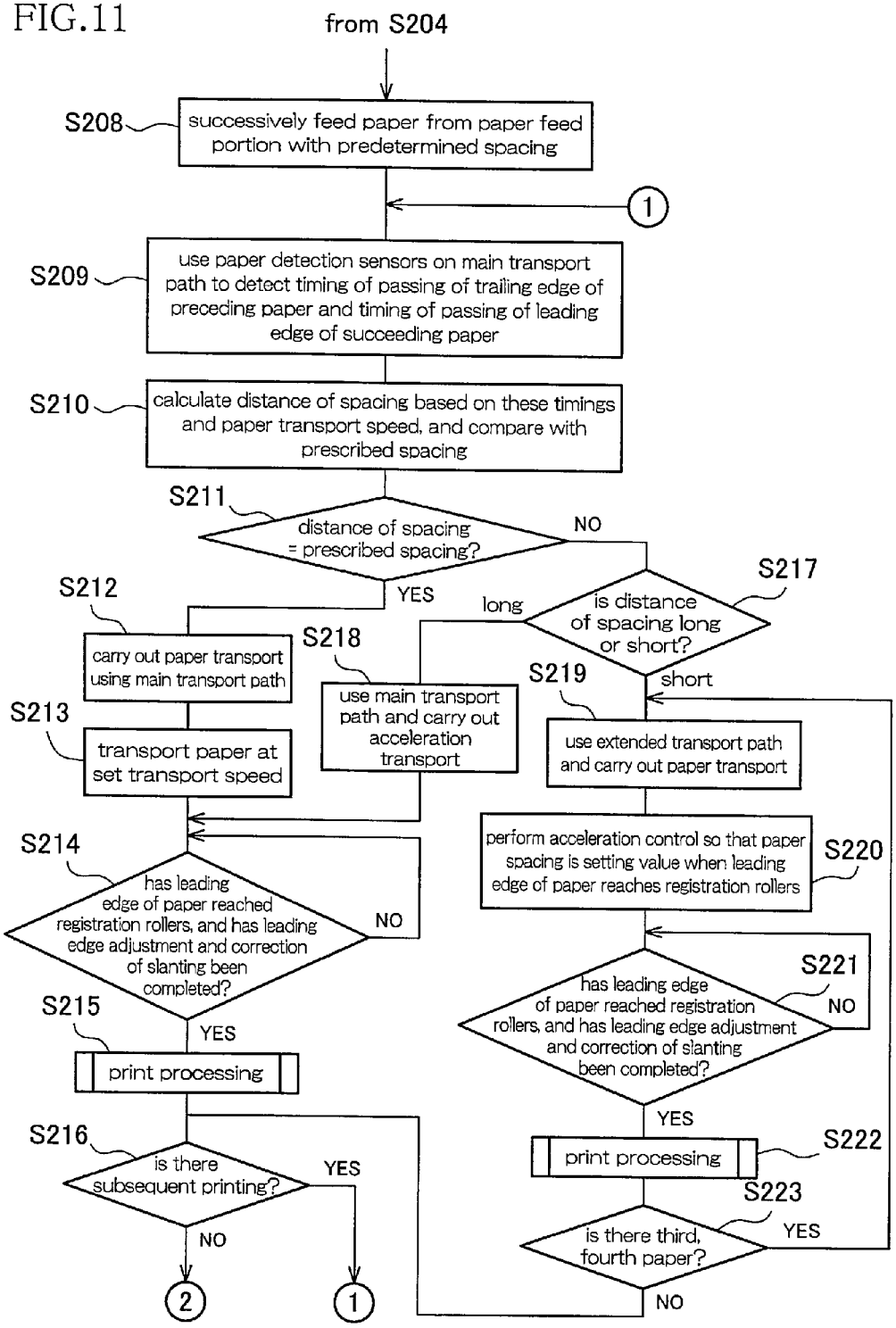
FIG. 11 is a flowchart showing the control process continuing on from FIG. 10.

Next, summary description is given of a control process for adjusting and maintaining the distance of spacing between the recording papers to the prescribed spacing with reference to flowcharts in FIG. 10 and FIG. 11.

First, when a print request is performed (step S201) by an operation on an operation panel (not shown in drawings) of the image forming apparatus 100, the print request is notified to the control portion 77. Upon receiving the print request, the control portion 77 stands by until all printing conditions such as print magnification, number of sheets of print request, and printing density are inputted ("No" at step S202) and displays a message or the like prompting input of printing conditions (step S203), and when all the printing conditions are inputted ("Yes" at step S202), determines whether or not printing of a plurality of sheets of recording paper has been requested (step S204).

For example, if printing of a single sheet of recording paper has been requested ("No" at step S204), then the control portion 77 performs drive control on the pickup roller 61 and the separator rollers 62 of one of the paper supply cassettes 51 such that a single sheet of recording paper is pulled out from the paper supply cassette 51 and fed out to the paper transport path 43 (step S205), then stands by until the leading edge of the recording paper contacts and aligns with the registration rollers 42 ("No" at step S206), then commences transport of the recording paper by the registration rollers 42 so that the leading edge of the recording paper reaches the transfer unit 25 with a timing at which transfer of the toner image on the surface of the photosensitive drum 21 commences ("Yes" at step S206) and feeds out the recording paper to the transfer unit 25 to carry out print processing on the recording paper (step S207). After this, the control portion 77 puts the image forming apparatus 100 into a standby state and repeats the processing from step S201 when subsequently there is a new print request.

Furthermore, if printing of a plurality of sheets of recording paper is requested ("Yes" at S204), then the control portion 77 performs intermittent drive control on the pickup roller 61 and the separator rollers 62 of the paper supply cassettes 51 such that the specified number of sheets of recording paper are consecutively pulled out from the paper supply cassettes 51 and fed out sheet by sheet to the paper transport path 43 (step S208).

Then the control portion 77 determines a time interval between a detected timing of a trailing edge of a preceding recording paper and a detected timing of a leading edge of a succeeding recording paper by the paper detection sensor 63*d* immediately before the transport rollers 41*d*, and determines a transport speed of the transport rollers 41*d* (semi-high speed v1), and determines the distance of spacing between the trailing edge of the preceding recording paper and the leading edge of the succeeding recording paper from the time interval and the transport speed (step S209). Further still, the control portion 77 reads out the prescribed spacing according to the size of the recording paper from a memory (not shown in drawings) and compares the distance of spacing with the prescribed spacing (step S210).

If a result of the comparison between the distance of spacing and the prescribed spacing at step S210 is that the distance of spacing and the prescribed spacing are equivalent ("Yes" at step S211), then the control portion 77 leaves the main transport path 71 as it is interposed between the transport rollers 41*d* and the pre-registration rollers 64, that is, does not change the length of the paper transport path 43 (step S212), then carries out control of the transport speed of the transport rollers 41*d* ordinarily to transport the succeeding recording paper (step S213).

Then, the control portion 77 stands by until the leading edge of the preceding recording paper contacts and aligns with the registration rollers 42 ("No" at step S214), then commences transport of the preceding recording paper by the registration rollers 42 so that the leading edge of the preceding recording paper reaches the transfer unit 25 with a timing at which transfer of the toner image on the surface of the photosensitive drum 21 commences ("Yes" at step S214) and feeds out the preceding recording paper to the transfer unit 25 to carry out print processing on the preceding recording paper (step S215). After this, if print processing of all the specified number of sheets of recording paper is not finished and there are remaining recording papers ("Yes" at step S216), then the control portion 77 returns to step S209 and if print processing of all the specified number of sheets of recording paper has been completed ("No" at step S216), then it puts the image forming apparatus into a standby state and repeats the processing from step S201 when subsequently there is a new print request.

Here, if print processing of all the specified number of sheets of recording paper is not finished and there are remaining recording papers ("Yes" at step S216), then the control portion 77 considers the first remaining recording paper to be the preceding recording paper and obtains the distance of spacing between the trailing edge of the preceding recording paper and the leading edge of the succeeding recording paper (step S209) at a timing at which the leading edge of the succeeding recording paper is detected by the detection sensor 63*d*, and compares this distance of spacing with the prescribed spacing (step S210).

If the distance of spacing is not equivalent to the prescribed spacing at this time ("No" at step S211), then the control portion 77 again determines whether the distance of spacing is longer or shorter than the prescribed spacing (step S217). Then, if the distance of spacing is longer than the prescribed spacing ("Long" at step S217), then the control portion 77 leaves the main transport path 71 as it is interposed between the transport rollers 41*d* and the pre-registration rollers 64, that is, does not change the length of the paper transport path 43, then carries out acceleration control on the second recording paper as shown in FIG. 9(*b*) such that the distance of spacing between the preceding recording paper and the succeeding recording paper is adjusted to the prescribed spacing (step S218).

Then, the control portion 77 stands by until the leading edge of the preceding recording paper contacts and aligns with the registration rollers 42 ("No" at step S214), then commences transport of the preceding recording paper by the registration rollers 42 matched to the timing at which transfer of the toner image commences ("Yes" at step S214) and carries out print processing on the preceding recording paper (step S215). After this, if there are remaining recording papers ("Yes" at step S216), then the control portion 77 returns to processing from step S209, and if the distance of spacing is not equivalent to the prescribed spacing ("No" at step S211) and the distance of spacing is longer than the prescribed spacing ("Long" at step S217), then it performs acceleration control on the third recording paper as shown in FIG. 9(*b*) and adjusts the distance of spacing between the preceding recording paper and the succeeding recording paper to the prescribed spacing (step S218), then carries out steps S214 and S215. Further still, acceleration control is carried out for the fourth recording paper as shown in FIG. 9(*b*) by a same procedure and the timing for pulling out the fifth recording paper from the paper supply cassettes 51 is controlled such that the distance of spacing between the fourth and fifth recording papers returns to the original spacing.

Furthermore, if the distance of spacing is not equivalent to the prescribed spacing ("No" at step S211) and the distance of spacing is shorter than the prescribed spacing ("Short" at step S217), then the control portion 77 energizes the solenoid 76 such that the transport path switching unit 73 rotationally moves and instead of the main transport path 71, the extended transport path 72 is interposed between the transport rollers 41*d* and the pre-registration rollers 64 to lengthen the paper transport path 43 (step S219), and moreover carries out acceleration control on the transport speed in the extended transport path 72 by the transport rollers 41*d* as shown in FIG. 7(*b*), then controls the distance of spacing between the preceding recording paper and the succeeding recording paper to the prescribed spacing (step S220) and commences transport of the preceding recording paper by the registration rollers 42 matched to the timing at which transfer of the toner image commences ("Yes" at step S221) and carries out print processing on the preceding recording paper (step S222).

Further still, if there are third and fourth recording papers ("Yes" at step S223), then control of the transport speed as shown in FIG. 7(*b*) is carried out each time preferentially and the distance of spacing for the third and fourth recording papers is adjusted sheet by sheet to the prescribed distance (steps S219 and S220) and steps S221 and S222 are repeated. In regard to the fifth recording paper P5, the distance of spacing between the fourth and fifth recording papers is returned to the original spacing by controlling the pulling out of the fifth recording paper from the paper supply cassettes 51. Then a switch is carried out from the extended transport path 72 to the main transport path 71 such that the main transport path 71 is interposed between the transport rollers 41*d* and the pre-registration rollers 64, and steps S209 to S216 are carried out.

After this, if there is a remaining recording paper ("Yes" at step S216), the control portion 77 returns to step S209. And if the print processing for all the specified number of sheets of recording paper is finished ("No" at step S216), then it puts the image forming apparatus 100 into a standby state and repeats the processing from step S201 when subsequently there is a new print request.

Thereafter, in the same manner, if the distance of spacing between the preceding recording paper and the succeeding recording paper and the prescribed distance are equivalent ("Yes" at step S211), then the control portion 77 leaves the main transport path 71 as it is interposed between the transport rollers 41*d* and the pre-registration rollers 64, and carries out control of the transport speed of the transport rollers 41*a* to 41*d* ordinarily to carry out print processing on the recording paper (steps S212 to S215). Furthermore, if the distance of spacing between the preceding recording paper and the succeeding recording paper is longer than the prescribed distance ("No" at step S211 and "long" at step S217), then the control portion 77 leaves the main transport path 71 as it is interposed between the transport rollers 41*d* and the pre-registration rollers 64, and controls the distance of spacing between the preceding recording paper and the succeeding recording paper by performing acceleration control on the transport speed as shown in FIG. 9(*b*), and carries out print processing on the recording paper (steps S218, S214, and S215). Further still, if the distance of spacing between the preceding recording paper and the succeeding recording paper is shorter than the prescribed distance ("No" at step S211 and "short" at step S217), then instead of the main transport path 71, the control portion 77 interposes the extended transport path 72 between the transport rollers 41*d* and the pre-registration rollers 64 to lengthen the paper transport path 43, and preferentially carries out acceleration control again on the transport speed in the extended transport path 72 by the transport rollers 41*d* as shown in FIG. 7(*b*), then controls the distance of spacing between the preceding recording paper and the succeeding recording paper to the prescribed distance and carries out print processing on the recording paper (steps S219 to S223).

With the present embodiment, when the distance of spacing between a preceding recording paper and a succeeding recording paper is short, the succeeding recording paper is transported through the extended transport path 72 and therefore the distance of spacing between the recording papers can be lengthened, such that the distance of spacing between the recording papers can be adjusted to the prescribed spacing by further performing acceleration control on the succeeding recording paper, and moreover since acceleration control is performed on the succeeding recording paper only, controlling the transport speed can be carried out easily.

Furthermore, when the distance of spacing between the recording papers is long, the main transport path 71 is used as it is and the distance of spacing between the recording papers is adjusted to the prescribed spacing by performing acceleration control on the recording papers, and therefore no deceleration control is required at all, which also simplifies control of the transport speed.

Further still, even where conventionally the distance of spacing between the recording papers become so short as to necessitate the handling of jams, by merely switching from the main transport path 71 to the extended transport path 72 the distance of spacing between the recording papers can be lengthened, and therefore the frequency of occurrences of jams can be reduced.

Furthermore, since the control by which the distance of spacing between the recording papers is adjusted to the prescribed spacing is simplified, the control is carried out reliably and the distance of spacing between the recording papers on the downstream side from the registration rollers 42 is maintained accurately, and as a result the timing by which transfer of the toner image on the surface of the photosensitive drum 21 commences and the timing by which the leading edge of the recording paper reaches the transfer unit 25 are matched accurately, which improves print quality. Further still, deterioration of the photosensitive drum 21 caused by direct application of the transfer electric field to the photosensitive drum 21 can be prevented and residual toner on the surface of the photosensitive drum 21, which is a cause of transfer discrepancies, can be reduced such that the load on the cleaning member (cleaning unit 26) can be reduced.

It should be noted that the present invention is not limited to the above-described embodiment, but includes variations that are possible within the scope of the claims. For example, not only for recording papers transported from the paper supply cassettes 51 to the transport rollers 41*d*, but also for recording papers transported through the reverse transport path 44*a*, the distance of spacing between the recording papers can be adjusted to the prescribed spacing by switching from the main transport path 71 to the extended transport path 72 and performing acceleration control on the transport speed. In this case, the trailing edge of the preceding recording paper and the leading edge of the succeeding recording paper may be detected by the paper detection sensor 63*f* on the reverse transport path 44*a* and distances of spacing between the recording papers are determined corresponding to the time intervals between these detection timings to adjust the distance of spacing.

Further still, when using a switch back transport path or the like for reversing the front and back of the recording paper rather than the reverse transport path shown in FIG. 1, the present invention can be applied to adjust the distance of spacing between the recording papers transported through the switch back transport path or the like to the prescribed spacing.

Figure 12:
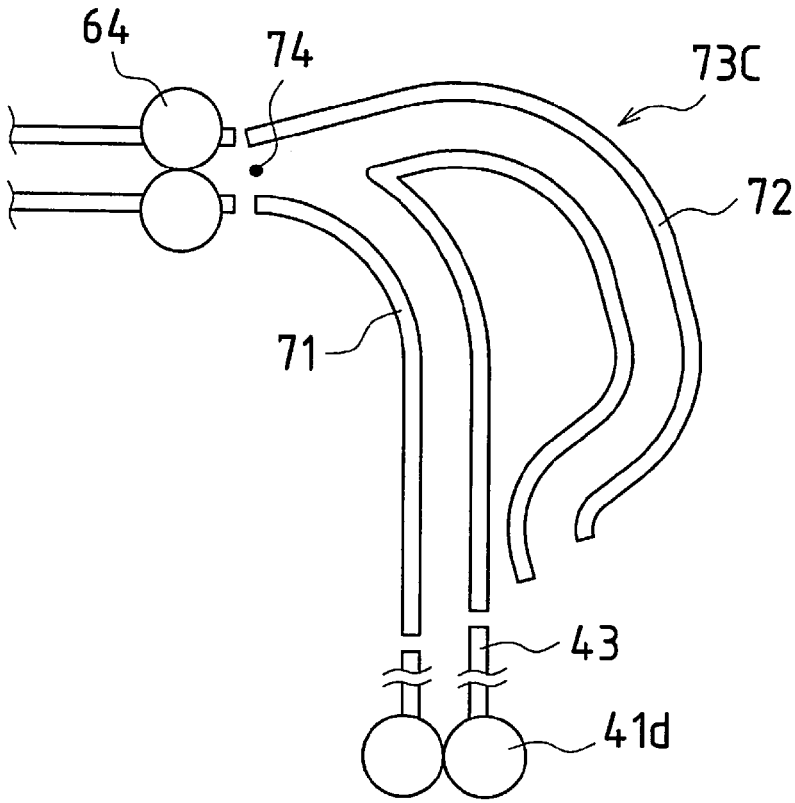
FIG. 12 is a cross-sectional view showing a modified example of the transport path switching unit in the image forming apparatus of FIG. 1.

Furthermore, a transport path switching unit 73C as shown in FIG. 12 may be applied instead of the transport path switching unit 73. With the transport path switching unit 73C, the outlets of the main transport path 71 and the extended transport path 72 are connected in common, and the transport path switching unit 73C is rotatably supported by the support shaft 74 on the outlet side. By rotating the transport path switching unit 73C clockwise around the support shaft 74, the main transport path 71 can be interposed and positioned as the part of the paper transport path 43 between the transport rollers 41*d* and the pre-registration rollers 64, and by rotating the transport path switching unit 73C counterclockwise, the extended transport path 72 can be interposed and positioned.

It should be noted that the transport path switching unit 73C is rotationally driven by the coil spring 75 and the solenoid 76 (not shown in drawings) in a same manner as the transport path switching unit 73 in FIG. 3.

Figure 13:
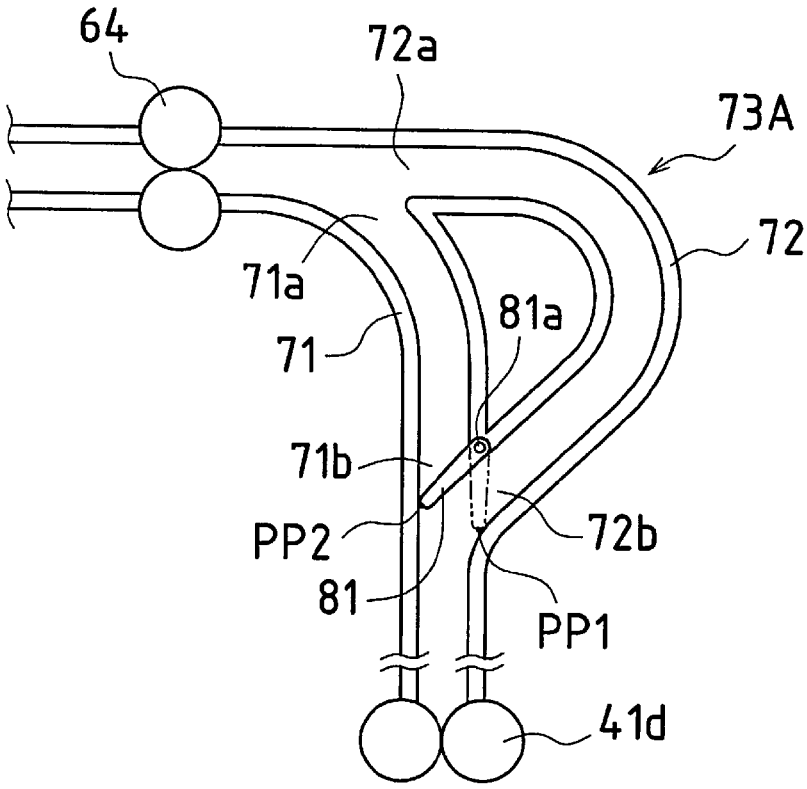
FIG. 13 is a cross-sectional view showing another modified example of the transport path switching unit in the image forming apparatus of FIG. 1.

Furthermore, a transport path switching unit 73A as shown in FIG. 13 may be applied instead of the transport path switching unit 73. With the transport path switching unit 73A, not only are the outlets 71*a* and 72*a* of the main transport path 71 and the extended transport path 72 joined in a V-shape, but the inlets 71*b* and 72*b* of the main transport path 71 and the extended transport path 72 are also joined in a V-shape, and a branching claw 81 is provided on the side of the inlets 71*b* and 72*b* of the main transport path 71 and the extended transport path 72. Furthermore, the transport path switching unit 73A is fixedly arranged between the transport rollers 41*d* and the pre-registration rollers 64.

The branching claw 81 is rotatably and axially supported by a shaft 81*a* at a location where the main transport path 71 and the extended transport path 72 are joined and is switchable between two positions PP1 and PP2 by a drive mechanism (not shown in drawings). For example, when the branching claw 81 is switched and positioned in the position PP1, the inlet 72*b* of the extended transport path 72 is closed and the recording paper is transported through the main transport path 71. And when the branching claw 81 is switched and positioned in the position PP2, the inlet 71*b* of the main transport path 71 is closed and the recording paper is transported through the extended transport path 72. Accordingly, the main transport path 71 and the extended transport path 72 can be switched and used merely by switching the position of the branching claw using the control portion 77 (shown in FIG. 3).

Figure 14:
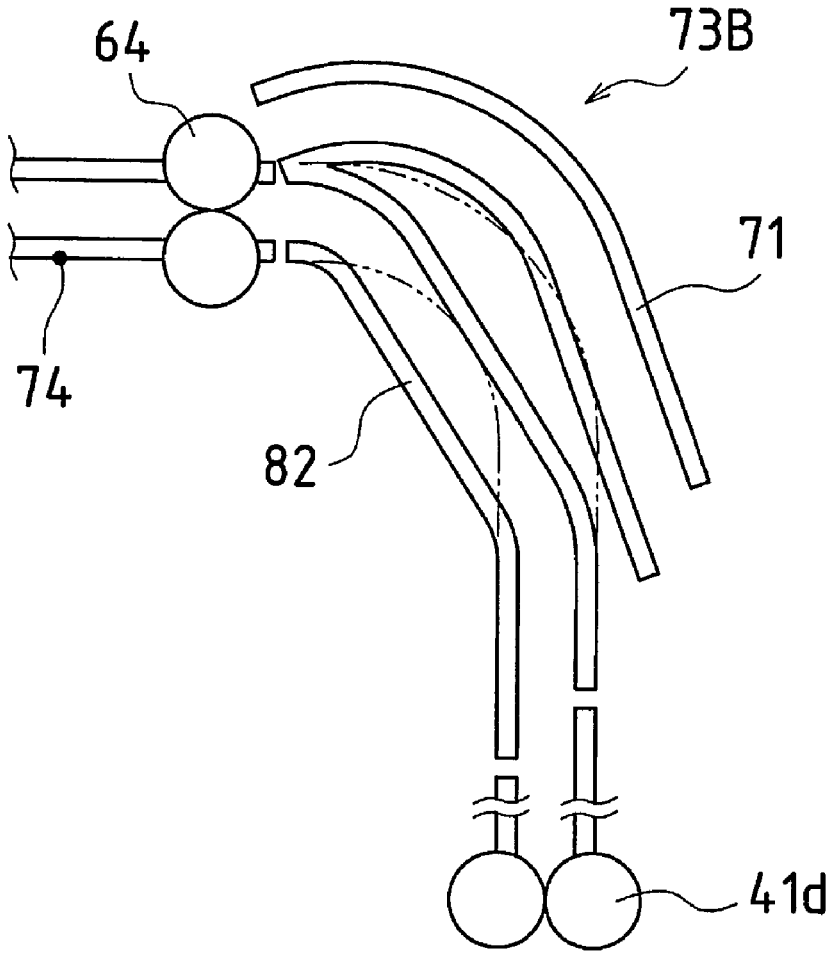
FIG. 14 is a cross-sectional view showing a different modified example of the transport path switching unit in the image forming apparatus of FIG. 1.

Furthermore, as shown in FIG. 14, a transport path switching unit 73B may be provided in which the main transport path 71 and a short transport path 82 are integrally combined, and the main transport path 71 and the short transport path 82 may be switched by rotating the transport path switching unit 73B around the support shaft 74. In this case, as long as the distance of spacing between the trailing edge of the preceding recording paper and the leading edge of the succeeding recording paper is matched to the prescribed spacing, the main transport path 71 remains as it is interposed between the transport rollers 41*d* and the pre-registration rollers 64, and drive control continues to be performed as it is on the pickup roller 61, the separator rollers 62, the transport rollers 41*a* to 41*d*, and the pre-registration rollers 64 such that the transport speed of the recording paper is maintained. Furthermore, if the distance of spacing between the recording papers becomes shorter than the prescribed spacing, then the main transport path 71 is left as it is interposed between the transport rollers 41*d* and the pre-registration rollers 64, that is, the length of the paper transport path 43 is not changed, and deceleration control is carried out on the transport speed as shown in FIG. 8(*b*) such that the distance of spacing between the preceding recording paper and the succeeding recording paper is adjusted to the prescribed spacing. Further still, if the distance of spacing between the recording papers exceeds the prescribed spacing, then the short transport path 82 is interposed between the transport rollers 41*d* and the pre-registration rollers 64 instead of the main transport path 71, and acceleration or deceleration control of the transport speed is carried out such that the distance of spacing between the preceding recording paper and the succeeding recording paper is adjusted to the prescribed spacing.

Further still, it is possible to provide all of the main transport path, the extended transport path, and the short transport path and to switch between and use these transport paths, then acceleration or deceleration control of the transport speed may be carried out such that the distance of spacing between the recording papers is adjusted to the prescribed spacing.

The present invention can be embodied and practiced in other different forms without departing from the spirit and essential characteristics thereof. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. An image forming apparatus comprising:

a paper transport path in which a recording paper is transported from a paper feed portion through the paper transport path to registration rollers and the recording paper is further transported to a print processing portion via the registration rollers such that printing is carried out on the recording paper by the print processing portion, wherein the paper transport path comprises a main transport path and an extended transport path which is longer than the main transport path, and a switching unit that switches between utilizing the main transport path or the extended transport path;

wherein the main transport path and the extended transport path are on an upstream side from the registration rollers in a transport direction of the recording paper, and based on the spacing between two successive sheets of recording paper the switching unit is controlled to switch between either the main transport path or the extended transport path such that the recording paper is guided to the registration rollers through either of the main transport path or the extended transport path, the main transport path is located on an upstream side of the print processing portion in the transport direction, while the recording paper is transported from the paper feed portion to the print processing portion, the recording paper passes through either of the main transport path or the extended transport path, as switched between each other by the switching unit, and the main transport path and extended transport path form an integrated component that is rotatable to switch between the main transport path and the extended transport path.

2. The paper transport path of an image forming apparatus according to claim 1, wherein a reverse transport path, in which the recording paper is transported while a front and back of the recording paper are reversed, is connected to the paper transport path, the main transport path and the extended transport path are provided between a connection location of the reverse transport path to the paper transport path and the registration rollers, and the reverse transport path and the extended transport path are different transport paths.

3. The paper transport path of an image forming apparatus according to claim 1, wherein a paper detection sensor that detects a leading edge and a trailing edge of the recording paper is provided on an upstream side from the main transport path and the extended transport path in a transport direction of the recording paper, and control of switching between the main transport path and the extended transport path is carried out based on a detection timing of a trailing edge of a preceding recording paper and a detection timing of a leading edge of a succeeding recording paper by the paper detection sensor in a state in which a plurality of sheets of recording paper is being transported successively.

4. The paper transport path of an image forming apparatus according to claim 3, wherein the extended transport path is used as at least a part of the paper transport path when a distance of spacing between a trailing edge and a leading edge of recording papers corresponding to a detection timing of a trailing edge of a preceding recording paper and a detection timing of a leading edge of a succeeding recording paper by the paper detection sensor is less than a prescribed spacing, and the main transport path is used as at least a part of the paper transport path when a distance of spacing between a trailing edge and a leading edge of the recording papers is not less than the prescribed spacing.

5. The paper transport path of an image forming apparatus according to claim 1, wherein when a recording paper is guided to the registration rollers through the extended transport path, transport acceleration control is carried out in which a transport speed of the recording paper in the extended transport path is increased.

6. The paper transport path of an image forming apparatus according to claim 5, wherein a paper detection sensor that detects a leading edge and a trailing edge of the recording paper is provided on an upstream side from the main transport path and the extended transport path in a transport direction of the recording paper, the extended transport path is used as at least a part of the paper transport path when a distance of spacing between a trailing edge and a leading edge of recording papers corresponding to a detection timing of a trailing edge of a preceding recording paper and a detection timing of a leading edge of a succeeding recording paper by the paper detection sensor is less than a prescribed spacing, and a transport speed for recording paper in the extended transport path is set based on a difference in length between the main transport path and the extended transport path, the prescribed spacing between the trailing edge and leading edge of the recording papers, and the distance of spacing between the trailing edge and leading edge of the recording papers such that an adjustment time is ensured from a time point at which the leading edge of the succeeding recording paper reaches the registration rollers until a time point at which transport of the succeeding recording paper by the registration rollers commences.

7. The paper transport path of an image forming apparatus according to claim 1, wherein a difference in length between the main transport path and the extended transport path is not less than a prescribed spacing between a preceding recording paper and a succeeding recording paper that is set when transporting a largest size recording paper printable by the image forming apparatus.

8. The paper transport path of an image forming apparatus according to claim 1, wherein transport speeds in the paper transport path, the main transport path, and the extended transport path are higher than a transport speed from the registration rollers to the print processing portion.

9. The paper transport path of an image forming apparatus according to claim 1, wherein an adjustment time from a time point at which a leading edge of the recording paper reaches the registration rollers until a time point at which transport of the recording paper by the registration rollers commences is set so that a timing at which printing on the recording paper by the print processing portion commences and a timing at which the leading edge of the recording paper reaches the print processing portion are matched.

10. The paper transport path of an image forming apparatus according to claim 1, wherein an adjustment time from a time point at which a leading edge of the recording paper reaches the registration rollers until a time point at which transport of the recording paper by the registration rollers commences is a time required for the leading edge of the recording paper to contact the registration rollers and be made parallel to the registration rollers.

* * * * *